US010002615B2

(12) United States Patent
Zhang et al.

(10) Patent No.: US 10,002,615 B2
(45) Date of Patent: Jun. 19, 2018

(54) INTER-CHANNEL LEVEL DIFFERENCE PROCESSING METHOD AND APPARATUS

(71) Applicant: Huawei Technologies Co., Ltd., Shenzhen (CN)

(72) Inventors: Xingtao Zhang, Beijing (CN); Lei Miao, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 300 days.

(21) Appl. No.: 14/931,975

(22) Filed: Nov. 4, 2015

(65) Prior Publication Data

US 2016/0055856 A1 Feb. 25, 2016

Related U.S. Application Data

(63) Continuation of application No. PCT/CN2014/070131, filed on Jan. 4, 2014.

(30) Foreign Application Priority Data

Jul. 16, 2013 (CN) ..... 2013 1 0298100

(51) Int. Cl.
*G10L 19/008* (2013.01)
*H04S 3/00* (2006.01)
*G10L 19/005* (2013.01)

(52) U.S. Cl.
CPC ..... *G10L 19/008* (2013.01); *G10L 19/005* (2013.01); *H04S 3/008* (2013.01); *H04S 2400/01* (2013.01); *H04S 2420/03* (2013.01)

(58) Field of Classification Search
CPC ..... G10L 19/008; G10L 19/005; H04S 3/008; H04S 2400/01; H04S 2420/03
(Continued)

(56) References Cited

U.S. PATENT DOCUMENTS

2011/0103591 A1 5/2011 Ojala
2011/0206209 A1 8/2011 Ojala
(Continued)

FOREIGN PATENT DOCUMENTS

CN 102027535 A 4/2011
CN 102157151 A 8/2011
(Continued)

OTHER PUBLICATIONS

"7 kHz audio-coding within 64 kbit/s: New Annex D with stereo embedded extension," ITU-T Recommendation G.722 Amendment D, Nov. 26, 2014, 52 pages.
(Continued)

*Primary Examiner* — Vivian Chin
*Assistant Examiner* — Douglas Suthers
(74) *Attorney, Agent, or Firm* — Conley Rose, P.C.

(57) ABSTRACT

An inter-channel level difference (ICLD) processing method and apparatus are disclosed. A stereo audio signal is received, and the stereo audio signal is parsed frame by frame, to obtain an ICLD of each sub-band of each subframe of each frame of the stereo audio signal; a sum of absolute values of the ICLDs of each subframe of any frame of the stereo audio signal is calculated; and when an absolute value of a difference between the sums of the absolute values of the ICLDs of each two subframes of the any frame is less than a preset threshold, a weighted ICLD value of each sub-band of the any frame is calculated in a first weighting manner; or otherwise, a weighted ICLD value of each sub-band of the any frame is calculated in a second weighting manner.

22 Claims, 6 Drawing Sheets

(58) Field of Classification Search
USPC ..... 381/22, 23
See application file for complete search history.

(56) References Cited

U.S. PATENT DOCUMENTS

| | | | |
|---|---|---|---|
| 2012/0224702 | A1 | 9/2012 | Den et al. |
| 2012/0265543 | A1 | 10/2012 | Lang et al. |

FOREIGN PATENT DOCUMENTS

| | | | |
|---|---|---|---|
| CN | 102577384 | A | 7/2012 |
| CN | 102598122 | A | 7/2012 |
| JP | 2013524267 | A | 6/2013 |

OTHER PUBLICATIONS

Foreign Communication From a Counterpart Application, European Application No. 14826895.6, Extended European Search Report dated Jun. 1, 2016, 8 pages.

Faller, C., et al., "Parametric Coding of Spatial Audio," Ecole Polytechnique Federale De Lausanne, 2004, 180 pages.

Foreign Communication From a Counterpart Application, Korean Application No. 10-2015-7032153, Korean Office Action dated Sep. 22, 2016, 5 pages.

Foreign Communication From a Counterpart Application, Korean Application No. 10-2015-7032153, English Translation of Korean Office Action dated Sep. 22, 2016, 3 pages.

Maitre, X., et al., "7 kHz Audio Coding Within 64 kbit/s," IEEE Journal on Selected Areas in Communications, vol. 6, No. 2, Feb. 1988, pp. 283-298.

Foreign Communication From a Counterpart Application, Japanese Application No. 2016-520245, Japanese Notice of Allowance dated Feb. 7, 2017, 3 pages.

Foreign Communication From a Counterpart Application, Chinese Application No. 201310298100.2, Chinese Office Action dated Feb. 6, 2017, 5 pages.

Foreign Communication From a Counterpart Application, PCT Application No. PCT/CN2014/070131, English Translation of International Search Report dated Apr. 16, 2014, 2 pages.

Foreign Communication From a Counterpart Application, PCT Application No. PCT/CN2014/070131, English Translation of Written Opinion dated Apr. 16, 2014, 10 pages.

INTER-CHANNEL LEVEL DIFFERENCE PROCESSING METHOD AND APPARATUS

CROSS-REFERENCE TO RELATED APPLICATIONS

This application is a continuation of International Application No. PCT/CN2014/070131, filed on Jan. 4, 2014, which claims priority to Chinese Patent Application No. 201310298100.2, filed on Jul. 16, 2013, both of which are hereby incorporated by reference in their entireties.

TECHNICAL FIELD

The present disclosure relates to the field of stereo audio technologies, and in particular, to an inter-channel level difference processing method and apparatus.

BACKGROUND

Improvement of life quality leads to increasing personal demands for high quality audio. Compared with monaural audio, stereo audio can improve definition and intelligibility of information, and therefore, is popular among people.

When stereo audio is processed in the prior art, an input stereo audio signal is parsed first, an inter-channel level difference (ICLD) value of each sub-band in a frame that carries the stereo audio signal is obtained, and then the obtained ICLD value is compared with obtained ICLD values of previous frames. When a difference between the ICLD value and the obtained ICLD values of the previous frames is great, the stereo audio signal carried by the frame is Transient; or otherwise, the stereo audio signal carried by the frame is Normal. For Transient, two frames are used for transmission, that is, an ICLD of an odd-numbered sub-band and an ICLD of an even-numbered sub-band are separately transmitted. For Normal, four frames are used for transmission, that is, each frame transmits an ICLD of a quarter of a sub-band. To ensure consistency in a quantity of bits, refinement processing is further performed on Normal.

However, when stereo audio is processed using the prior art, because a frame that carries the stereo audio is relatively long, when 10 milliseconds (ms) of stereo audio is processed, if Normal is processed using four frames, it is equivalent to that an ICLD is updated every 40 ms (4*10 ms), which cannot ensure quality of decoded stereo audio in a case that a signal changes quickly or in a case of packet loss, and in addition, if the ICLD is transmitted frame by frame, low bit-rate transmission of a stereo audio signal cannot be implemented.

SUMMARY

Embodiments of the present disclosure provide an ICLD processing method and apparatus, which can ensure quality of decoded stereo audio in a case that a signal changes quickly or in a case of packet loss, and implement low bit-rate transmission of a stereo audio signal.

According to a first aspect, an embodiment of the present disclosure provides an ICLD processing method, including receiving a stereo audio signal, and parsing the stereo audio signal frame by frame, to obtain an ICLD of each sub-band of each subframe of each frame of the stereo audio signal, where each frame includes at least two subframes; calculating a sum of absolute values of the ICLDs of each subframe of any frame of the stereo audio signal according to the obtained ICLD of each sub-band of each subframe of each frame of the stereo audio signal; and when an absolute value of a difference between the sums of the absolute values of the ICLDs of each two subframes of the any frame is less than a preset threshold, calculating a weighted ICLD value of each sub-band of the any frame in a first weighting manner; or when an absolute value of a difference between the sums of the absolute values of the ICLDs of any two subframes of the any frame is greater than or equal to a preset threshold, calculating a weighted ICLD value of each sub-band of the any frame in a second weighting manner.

In a first possible implementation manner, with reference to the first aspect, the calculating a weighted ICLD value of each sub-band of the any frame in a first weighting manner includes calculating a first weighting factor of a $b^{th}$ sub-band of an $i^{th}$ subframe according to a quantity of subframes included in the any frame, where i represents any subframe included in the any frame, and $0<i\leq L$; L is the quantity of subframes included in the any frame, and $L\geq 2$; b represents any sub-band of the $i^{th}$ subframe, and $0<b\leq K$; and K represents a quantity of sub-bands included in any subframe, and $K\geq 12$; and calculating a weighted ICLD value of the $b^{th}$ sub-band of the any frame according to the first weighting factor and an ICLD of the $b^{th}$ sub-band of the $i^{th}$ subframe of the any frame.

In a second possible implementation manner, with reference to the first possible implementation manner of the first aspect, the calculating a first weighting factor of a $b^{th}$ sub-band of an $i^{th}$ subframe according to a quantity of subframes included in the any frame includes calculating the first weighting factor of the $b^{th}$ sub-band of the $i^{th}$ subframe according to $fac_1(i,b)=1/L$, where $fac_1(i,b)$ represents the first weighting factor of the $b^{th}$ sub-band of the $i^{th}$ subframe.

In a third possible implementation manner, with reference to the second possible implementation manner of the first aspect, the calculating a weighted ICLD value of the $b^{th}$ sub-band of the any frame according to the first weighting factor and an ICLD of the $b^{th}$ sub-band of the $i^{th}$ subframe of the any frame includes calculating the weighted ICLD value of the $b^{th}$ sub-band of the any frame according $$\text{level}(b) = \sum_{i=1}^{L} fac_1(i, b) * \text{level}(i, b),$$

where level(b) represents the weighted ICLD value of the $b^{th}$ sub-band of the any frame, and level(i, b) represents the ICLD of the $b^{th}$ sub-band of the $i^{th}$ subframe.

In a fourth possible implementation manner, with reference to the first aspect, the calculating a weighted ICLD value of each sub-band of the any frame in a second weighting manner includes calculating a second weighting factor of a $b^{th}$ sub-band of an $i^{th}$ subframe according to the calculated sum of the absolute values of the ICLDs of each subframe of the any frame of the stereo audio signal, or according to an ICLD of the $b^{th}$ sub-band of the $i^{th}$ subframe of the any frame, where i represents any subframe included in the any frame, and $0<i\leq L$; L is a quantity of subframes included in the any frame, and $L\geq 2$; b represents any sub-band of the $i^{th}$ subframe, and $0<b\leq K$; and K represents a quantity of sub-bands included in any subframe, and $K\geq 12$; and calculating a weighted ICLD value of the $b^{th}$ sub-band of the any frame according to the second weighting factor and the ICLD of the $b^{th}$ sub-band of the $i^{th}$ subframe of the any frame.

In a fifth possible implementation manner, with reference to the fourth possible implementation manner of the first aspect, the calculating a second weighting factor of a $b^{th}$ sub-band of an $i^{th}$ subframe according to the calculated sum of the absolute values of the ICLDs of each subframe of the any frame of the stereo audio signal includes calculating the second weighting factor of the $b^{th}$ sub-band of the $i^{th}$ subframe according to $$fac_2(i, b) = \text{sum}(i) \Big/ \sum_{j=1}^{L} \text{sum}(j),$$

where $fac_2(i,b)$ is the second weighting factor of the $b^{th}$ sub-band of the $i^{th}$ subframe, sum(i) represents a sum of absolute values of ICLDs of all sub-bands of the $i^{th}$ subframe, sum(j) represents a sum of absolute values of ICLDs of all sub-bands of a $j^{th}$ subframe, j is any subframe included in the any frame, and $0<j\leq L$.

In a sixth possible implementation manner, with reference to the fourth possible implementation manner of the first aspect, the calculating a second weighting factor of a $b^{th}$ sub-band of an $i^{th}$ subframe according to an ICLD of the $b^{th}$ sub-band of the $i^{th}$ subframe of the any frame includes calculating the second weighting factor of the $b^{th}$ sub-band of the $i^{th}$ subframe according to $$fac_2(i, b) = |\text{level}(i, b)| \Big/ \sum_{j=1}^{L} |\text{level}(j, b)|,$$

where level(i, b) represents the ICLD of the $b^{th}$ sub-band of the $i^{th}$ subframe, and level(j, b) represents an ICLD of a $b^{th}$ sub-band of the $j^{th}$ subframe.

In a seventh possible implementation manner, with reference to the sixth possible implementation manner of the first aspect, the calculating a second weighting factor of a $b^{th}$ sub-band of an $i^{th}$ subframe according to an ICLD of the $b^{th}$ sub-band of the $i^{th}$ subframe of the any frame includes calculating the second weighting factor of the $b^{th}$ sub-band of the $i^{th}$ subframe according to $$fac_2(i, b) = \left\{ \begin{array}{ll} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(I, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \leq b \leq K - \lfloor M/2 \rfloor \end{array} \right\},$$

where M represents a quantity of adjacent sub-bands, and l represents a difference between an index number of an adjacent sub-band and an index number of a current sub-band.

In an eighth possible implementation manner, with reference to the fourth possible implementation manner, or the fifth possible implementation manner, or the sixth possible implementation manner, or the seventh possible implementation manner of the first aspect, the calculating a weighted ICLD value of the $b^{th}$ sub-band of the any frame according to the second weighting factor and the ICLD of the $b^{th}$ sub-band of the $i^{th}$ subframe of the any frame includes calculating the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, $fac_2(i,b)$ is the second weighting factor of the $b^{th}$ sub-band of the $i^{th}$ subframe, and level(i, b) represents the ICLD of the $b^{th}$ sub-band of the $i^{th}$ subframe.

According to a second aspect, an embodiment of the present disclosure provides an ICLD processing apparatus, including a receiving unit configured to receive a stereo audio signal; a parsing unit configured to parse the stereo audio signal frame by frame according to the stereo audio signal received by the receiving unit, to obtain an ICLD of each sub-band of each subframe of each frame of the stereo audio signal, where each frame includes at least two subframes; a calculation unit configured to calculate a sum of absolute values of the ICLDs of each subframe of any frame of the stereo audio signal according to the ICLD that is of each sub-band of each subframe of each frame of the stereo audio signal and that is obtained by parsing by the parsing unit; a first weighting processing unit configured to, when an absolute value of a difference between the sums of the absolute values of the ICLDs of each two subframes of the any frame is less than a preset threshold, calculate a weighted ICLD value of each sub-band of the any frame in a first weighting manner; and a second weighting processing unit configured to, when an absolute value of a difference between the sums of the absolute values of the ICLDs of any two subframes of the any frame is greater than or equal to the preset threshold, calculate a weighted ICLD value of each sub-band of the any frame in a second weighting manner.

In a first possible implementation manner, with reference to the second aspect, the first weighting processing unit includes a first calculation module configured to calculate a first weighting factor of a $b^{th}$ sub-band of an $i^{th}$ subframe according to a quantity of subframes included in the any frame, where i represents any subframe included in the any frame, and $0<i\leq L$; L is the quantity of subframes included in the any frame, and $L\geq 2$; b represents any sub-band of the $i^{th}$ subframe, and $0<b\leq K$; and K represents a quantity of sub-bands included in any subframe, and $K\geq 12$; and a second calculation module configured to calculate a weighted ICLD value of the $b^{th}$ sub-band of the any frame according to the first weighting factor and an ICLD of the $b^{th}$ sub-band of the $i^{th}$ subframe of the any frame.

In a second possible implementation manner, with reference to the first possible implementation manner of the second aspect, the first calculation module is configured to calculate the first weighting factor of the $b^{th}$ sub-band of the $i^{th}$ subframe according to $fac_1(i,b)=1/L$, where $fac_1(i,b)$ represents the first weighting factor of the $b^{th}$ sub-band of the $i^{th}$ subframe.

In a third possible implementation manner, with reference to the second possible implementation manner of the second aspect, the second calculation module is configured to calculate the weighted ICLD value of the $b^{th}$ sub-band of the any frame according to $$\text{level}(b) = \sum_{i=1}^{L} fac_1(i, b) * \text{level}(i, b),$$

where level(b) represents the weighted ICLD value of the $b^{th}$ sub-band of the any frame, and Level(I,b) represents the ICLD of the $b^{th}$ sub-band of the $i^{th}$ subframe.

In a fourth possible implementation manner, with reference to the second aspect, the second weighting processing unit includes a third calculation module configured to calculate a second weighting factor of a $b^{th}$ sub-band of an $i^{th}$ subframe according to the calculated sum of the absolute values of the ICLDs of each subframe of the any frame of the stereo audio signal, where i represents any subframe included in the any frame, and $0<i\leq L$; L is a quantity of subframes included in the any frame, and $L\geq 2$; b represents any sub-band of the $i^{th}$ subframe, and $0<b\leq K$; and K represents a quantity of sub-bands included in any subframe, and $K\geq 12$; or a fourth calculation module configured to calculate a second weighting factor of a $b^{th}$ sub-band of an $i^{th}$ subframe according to an ICLD of the $b^{th}$ sub-band of the $i^{th}$ subframe of the any frame; and a fifth calculation module configured to calculate a weighted ICLD value of the $b^{th}$ sub-band of the any frame according to the second weighting factor and the ICLD of the $b^{th}$ sub-band of the $i^{th}$ subframe of the any frame.

In a fifth possible implementation manner, with reference to the fourth possible implementation manner of the second aspect, the third calculation module is configured to calculate the second weighting factor of the $b^{th}$ sub-band of the $i^{th}$ subframe according to $$fac_2(i, b) = \text{sum}(i) \Big/ \sum_{j=1}^{L} \text{sum}(j),$$

where $fac_2(i,b)$ is the second weighting factor of the $b^{th}$ sub-band of the $i^{th}$ subframe, sum(i) represents a sum of absolute values of ICLDs of all sub-bands of the $i^{th}$ subframe, sum(j) represents a sum of absolute values of ICLDs of all sub-bands of a $j^{th}$ subframe, j is any subframe included in the any frame, and $0<j\leq L$.

In a sixth possible implementation manner, with reference to the fifth possible implementation manner of the second aspect, the fourth calculation module is configured to calculate the second weighting factor of the $b^{th}$ sub-band of the $i^{th}$ subframe according to $$fac_2(i, b) = |\text{level}(ib)| \Big/ \sum_{j=1}^{L} |\text{level}(j, b)|,$$

where level(i, b) represents the ICLD of the $b^{th}$ sub-band of the $i^{th}$ subframe, and level(j, b) represents an ICLD of a $b^{th}$ sub-band of the $j^{th}$ subframe.

In a seventh possible implementation manner, with reference to the sixth possible implementation manner of the second aspect, the fourth calculation module is configured to calculate the second weighting factor of the $b^{th}$ sub-band of the $i^{th}$ subframe according to $$fac_2(i, b) = \left\{ \begin{array}{ll} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(I, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \leq b \leq K - \lfloor M/2 \rfloor \end{array} \right\},$$

where M represents a quantity of adjacent sub-bands, and l represents a difference between an index number of an adjacent sub-band and an index number of a current sub-band.

In an eighth possible implementation manner, with reference to the fourth possible implementation manner, or the fifth possible implementation manner, or the sixth possible implementation manner, or the seventh possible implementation manner of the second aspect, the fifth calculation module is configured to calculate the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, $fac_2(i,b)$ is the second weighting factor of the $b^{th}$ sub-band of the $i^{th}$ subframe, and level(i, b) represents the ICLD of the $b^{th}$ sub-band of the $i^{th}$ subframe.

According to the ICLD processing method provided by this embodiment of the present disclosure, a stereo audio signal is received, and the stereo audio signal is parsed frame by frame, to obtain an ICLD of each sub-band of each subframe of each frame of the stereo audio signal, where each frame includes at least two subframes; a sum of absolute values of the ICLDs of each subframe of any frame of the stereo audio signal is calculated according to the obtained ICLD of each sub-band of each subframe of each frame of the stereo audio signal; and when an absolute value of a difference between the sums of the absolute values of the ICLDs of each two subframes of the any frame is less than a preset threshold, a weighted ICLD value of each sub-band of the any frame is calculated in a first weighting manner; or when an absolute value of a difference between the sums of the absolute values of the ICLDs of any two subframes of the any frame is greater than or equal to a preset threshold, a weighted ICLD value of each sub-band of the any frame is calculated in a second weighting manner. In the prior art, because a frame that carries stereo audio is relatively long, when 10 ms of stereo audio is processed, if Normal is processed using four frames, it is equivalent to that an ICLD is updated every 40 ms (4*10 ms), which cannot ensure quality of decoded stereo audio in a case that a signal changes quickly or in a case of packet loss, and in addition, if the ICLD is transmitted frame by frame, low bit-rate transmission of a stereo audio signal cannot be implemented. Compared with that in the prior art, in the present disclosure, weighting processing is performed on an ICLD of any subframe based on relevance between subframes, such that it can be seen from experimental data obtained using the method provided by this embodiment of the present disclosure that the quality of decoded stereo audio is ensured in the case that a signal changes quickly or in the case of packet loss, and the low bit-rate transmission of the stereo audio signal is implemented.

BRIEF DESCRIPTION OF DRAWINGS

To describe the technical solutions in the embodiments of the present disclosure more clearly, the following briefly introduces the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
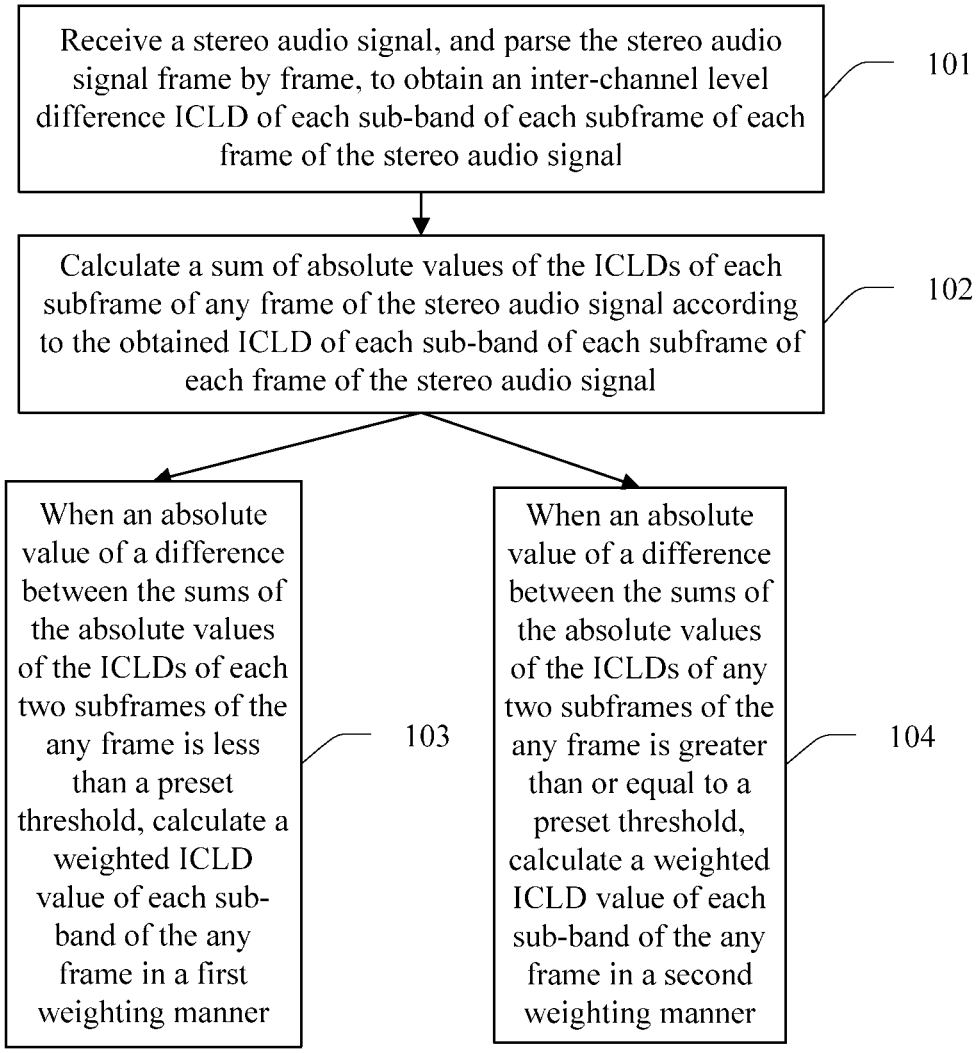
FIG. 1 is a flowchart of an ICLD processing method according to an embodiment of the present disclosure.

An embodiment of the present disclosure provides an ICLD processing method, where the method is applied to an encoder that processes stereo audio. As shown in FIG. 1, the method includes the following steps.

Step 101: Receive a stereo audio signal, and parse the stereo audio signal frame by frame, to obtain an ICLD of each sub-band of each subframe of each frame of the stereo audio signal, where each frame includes at least two subframes.

The stereo audio signal may be constituted by many frames. In this step, each frame may be further divided into multiple subframes, and each subframe may be divided into multiple sub-bands. It should be noted that, in an actual application, each frame includes an even quantity of subframes, and each frame may include at least two subframes. For example, one frame includes two subframes, or one frame includes four subframes, or one frame includes six subframes. Each subframe includes at least 12 sub-bands.

The ICLD is used to distinguish a horizontal angle of a stereo audio source and describes an intensity difference between audio channels, and this parameter affects frequency components of an entire frequency spectrum. Further, optionally, the ICLD is a power ratio between two input audio channel signals. For example, an ICLD value of a $b^{th}$ sub-band is:

$$\text{level}(b) = 10\log_{10}\frac{\sum_{p=A_{b-1}}^{A_b-1} X_L(p)X_L^*(p)}{\sum_{p=A_{b-1}}^{A_b-1} X_R(p)X_R^*(p)},$$

where $X_L(p)$ and $X_R(p)$ are a frequency domain coefficient of a left audio channel and a frequency domain coefficient of a right audio channel, respectively; P is a frequency bin value; a calculation range of level(b) is $A_{b-1} \le p < A_b$, where $A_{b-1}$ and $A_b$ represent frequency bin values corresponding to different frequencies; b represents any sub-band of the $i^{th}$ subframe, and $0 < b \le K$; and K represents a quantity of sub-bands included in any subframe, and $K \ge 12$. It should be noted that, K indicates that, to approximately simulate a human-ear auditory characteristic, frequency spectrum coefficients having a same frequency resolution may be divided into K non-overlapping sub-bands according to a critical band theory.

Step 102: Calculate a sum of absolute values of the ICLDs of each subframe of any frame of the stereo audio signal according to the obtained ICLD of each sub-band of each subframe of each frame of the stereo audio signal.

Optionally, the sum of the absolute values of the ICLDs of each subframe of the any frame of the stereo audio signal is calculated according to $$\text{Sum}(i) = \sum_{b=1}^{K} \text{level}(b),$$

where i represents any subframe included in the any frame, and $0 < i \le L$; and L is a quantity of subframes included in the any frame, and $L \ge 2$.

Step 103: When an absolute value of a difference between the sums of the absolute values of the ICLDs of each two subframes of the any frame is less than a preset threshold, calculate a weighted ICLD value of each sub-band of the any frame in a first weighting manner.

Optionally, the preset threshold is an empirically obtained threshold.

When $|\text{sum}(i)-\text{sum}(j)| < TH$, it is determined that the ICLDs of one of the two subframes are close to the ICLDs of the other one of the two subframes, and the weighted ICLD value of each sub-band of the any frame is calculated in the first weighting manner, where sum(i) and sum(j) represent a sum of absolute values of ICLDs of an $i^{th}$ subframe and that of a $j^{th}$ subframe, respectively; j represents any subframe included in the any frame, and $0 < j \le L$; and L is the quantity of subframes included in the any frame, and $L \ge 2$.

Optionally, this step includes calculating a first weighting factor of a $b^{th}$ sub-band of an $i^{th}$ subframe according to the quantity of subframes included in the any frame; and calculating a weighted ICLD value of the $b^{th}$ sub-band of the any frame according to the first weighting factor and an ICLD of the $b^{th}$ sub-band of the $i^{th}$ subframe of the any frame.

Further, optionally, the calculating a first weighting factor of a $b^{th}$ sub-band of an $i^{th}$ subframe according to the quantity of subframes included in the any frame includes calculating the first weighting factor of the $b^{th}$ sub-band of the $i^{th}$ subframe according to $fac_1(i,b)=1/L$, where $fac_1(i,b)$ represents the first weighting factor of the $b^{th}$ sub-band of the $i^{th}$ subframe.

Further, optionally, the calculating a weighted ICLD value of the $b^{th}$ sub-band of the any frame according to the first weighting factor and an ICLD of the $b^{th}$ sub-band of the $i^{th}$ subframe of the any frame includes calculating the weighted ICLD value of the $b^{th}$ sub-band of the any frame according to $$\text{level}(b) = \sum_{i=1}^{L} fac_1(i, b) * \text{level}(i, b),$$

where level(b) represents the weighted ICLD value of the $b^{th}$ sub-band of the any frame, and level(i, b) represents the ICLD of the $b^{th}$ sub-band of the $i^{th}$ subframe.

Step 104: When an absolute value of a difference between the sums of the absolute values of the ICLDs of any two subframes of the any frame is greater than or equal to a preset threshold, calculate a weighted ICLD value of each sub-band of the any frame in a second weighting manner.

In this step, when $|\text{sum}(i)-\text{sum}(j)| \geq TH$, it is determined that the ICLDs of one of the any two subframes are greatly different from the ICLDs of the other of the any two subframes, and the weighted ICLD value of each sub-band of the any frame is calculated in the second weighting manner. It should be noted that, that an absolute value of a difference between the sums of the absolute values of the ICLDs of any two subframes included in the any frame is greater than or equal to a preset threshold can be construed as absolute values of all differences are greater than or equal to the preset threshold; or absolute values of some differences are less than the preset threshold, and absolute values of the other differences are greater than or equal to the preset threshold.

Optionally, this step includes calculating a second weighting factor of a $b^{th}$ sub-band of an $i^{th}$ subframe according to the calculated sum of the absolute values of the ICLDs of each subframe of the any frame of the stereo audio signal, or according to an ICLD of the $b^{th}$ sub-band of the $i^{th}$ subframe of the any frame, where i represents any subframe included in the any frame, and $0<i\leq L$; L is the quantity of subframes included in the any frame, and $L\geq 2$; b represents any sub-band of the $i^{th}$ subframe, and $0<b\leq K$; and K represents a quantity of sub-bands included in any subframe, and $K\geq 12$; and calculating a weighted ICLD value of the $b^{th}$ sub-band of the any frame according to the second weighting factor and the ICLD of the $b^{th}$ sub-band of the $i^{th}$ subframe of the any frame.

Further, optionally, the calculating a second weighting factor of a $b^{th}$ sub-band of an $i^{th}$ subframe according to the calculated sum of the absolute values of the ICLDs of each subframe of the any frame of the stereo audio signal includes calculating the second weighting factor of the $b^{th}$ sub-band of the $i^{th}$ subframe according to $$fac_2(i, b) = \text{sum}(i) \Big/ \sum_{j=1}^{L} \text{sum}(j),$$

where $fac_2(i,b)$ is the second weighting factor of the $b^{th}$ sub-band of the $i^{th}$ subframe, sum(i) represents a sum of absolute values of ICLDs of all sub-bands of the $i^{th}$ subframe, sum(j) represents a sum of absolute values of ICLDs of all sub-bands of a $j^{th}$ subframe, j is any subframe included in the any frame, and $0<j\leq L$.

Further, optionally, the calculating a second weighting factor of a $b^{th}$ sub-band of an $i^{th}$ subframe according to an ICLD of the $b^{th}$ sub-band of the $i^{th}$ subframe of the any frame includes calculating the second weighting factor of the $b^{th}$ sub-band of the $i^{th}$ subframe according to $$fac_2(i, b) = |\text{level}(ib)| \Big/ \sum_{j=1}^{L} |\text{level}(j, b)|,$$

where level(i, b) represents the ICLD of the $b^{th}$ sub-band of the $i^{th}$ subframe, and level(j, b) represents an ICLD of a $b^{th}$ sub-band of a $j^{th}$ subframe.

Further, optionally, the calculating a second weighting factor of a $b^{th}$ sub-band of an $i^{th}$ subframe according to an ICLD of the $b^{th}$ sub-band of the $i^{th}$ subframe of the any frame includes calculating the second weighting factor of the $b^{th}$ sub-band of the $i^{th}$ subframe according to $$fac_2(i, b) = \left\{ \begin{array}{ll} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(I, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \leq b \leq K - \lfloor M/2 \rfloor \end{array} \right\},$$

where M represents a quantity of adjacent sub-bands, and l represents a difference between an index number of an adjacent sub-band and an index number of a current sub-band. It should be noted that one subframe may be divided into K sub-bands, such as sub-band 1, sub-band 2, . . . , and sub-band K, where 1, 2, . . . , and K here are index numbers of the sub-bands. "⌊ ⌋" represents rounding down, and "⌈ ⌉" represents rounding up.

Further, optionally, the calculating a weighted ICLD value of the $b^{th}$ sub-band of the any frame according to the second weighting factor and the ICLD of the $b^{th}$ sub-band of the $i^{th}$ subframe of the any frame includes calculating the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, $fac_2(i,b)$ is the second weighting factor of the $b^{th}$ sub-band of the $i^{th}$ subframe, and level(i, b) represents the ICLD of the $b^{th}$ sub-band of the $i^{th}$ subframe.

Further, optionally, after this step, quantization processing is performed on the obtained weighted ICLD value. Optionally, the quantization processing here is acquiring, according to a comparison between a preset codebook and the weighted ICLD value, a value that is in the preset codebook and that is closest to the weighted ICLD value. For example, the weighted ICLD value is 1.4, and the preset codebook includes values such as 0 and 2, such that a value obtained after the quantization processing is performed on the weighted ICLD value is 2.

Further, optionally, to reduce transmitted bits on the premise that quality of decoded stereo audio is ensured, when the quantization processing is performed, a difference between a current weighted ICLD value and a previous weighted ICLD value may be calculated and the quantization processing is performed on the calculated difference. For example, one subframe is divided into 15 sub-bands, the quantization processing is directly performed on a weighted ICLD value of a first sub-band; when the quantization processing is performed on a weighted ICLD value of a second sub-band, a difference between the weighted ICLD value of the second sub-band and the weighted ICLD value of the first sub-band is calculated first, and then the quantization processing is performed on the calculated difference, so as to obtain a quantization result of the weighted ICLD value of the second sub-band. Quantization results of weighted ICLD values of the other sub-bands may be calculated sequentially according to the method for calculating the quantization result of the weighted ICLD value of the second sub-band.

According to the ICLD processing method provided by this embodiment of the present disclosure, a sum of absolute values of ICLDs of each subframe of any frame of the stereo audio signal is calculated according to an obtained ICLD of each sub-band of each subframe of each frame of the stereo audio signal; and when an absolute value of a difference between the sums of the absolute values of the ICLDs of each two subframes of the any frame is less than a preset threshold, a weighted ICLD value of each sub-band of the any frame is calculated in a first weighting manner; or when an absolute value of a difference between the sums of the absolute values of the ICLDs of any two subframes of the any frame is greater than or equal to a preset threshold, a weighted ICLD value of each sub-band of the any frame is calculated in a second weighting manner. In the prior art, because a frame that carries stereo audio is relatively long, when 10 ms of stereo audio is processed, if Normal is processed using four frames, it is equivalent to that an ICLD is updated every 40 ms (4*10 ms), which cannot ensure quality of decoded stereo audio in a case that a signal changes quickly or in a case of packet loss, and in addition, if the ICLD is transmitted frame by frame, low bit-rate transmission of a stereo audio signal cannot be implemented. Compared with that in the prior art, in the present disclosure, weighting processing is performed on an ICLD of a subframe of any frame based on relevance between subframes, such that the quality of decoded stereo audio is ensured in the case that a signal changes quickly or in the case of packet loss, and the low bit-rate transmission of the stereo audio signal is implemented.

Figure 2:
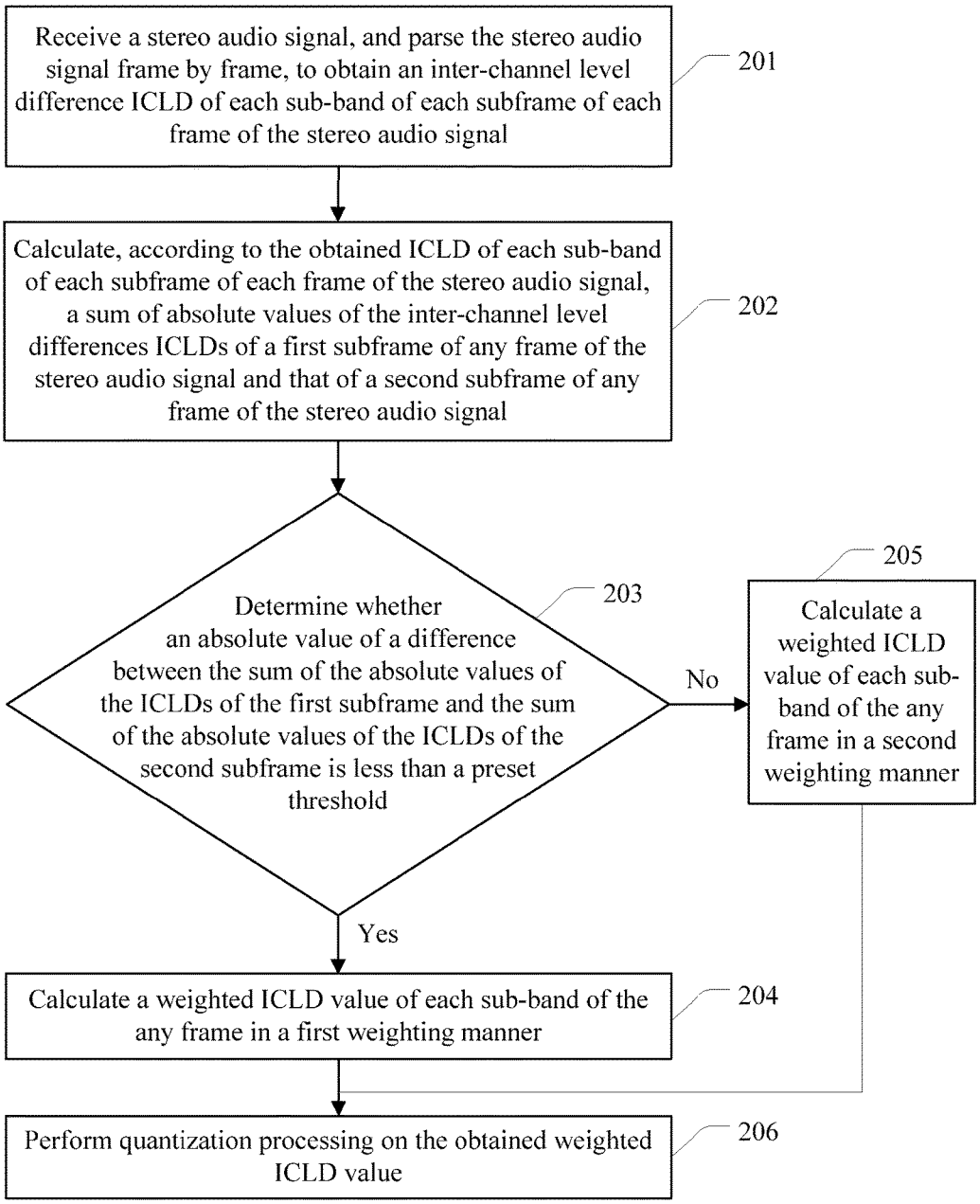
FIG. 2 is a flowchart of an ICLD processing method according to another embodiment of the present disclosure.

An embodiment of the present disclosure provides an ICLD processing method. In this embodiment, that one frame includes two subframes is used for detailed description, where, for example, one frame includes a first subframe and a second subframe. As shown in FIG. 2, the method includes the following steps.

Step 201: Receive a stereo audio signal, and parse the stereo audio signal frame by frame, to obtain an ICLD of each sub-band of each subframe of each frame of the stereo audio signal.

In this embodiment, each frame includes two subframes. That is, the stereo audio signal is received, and the stereo audio signal is parsed frame by frame, such that the ICLD of each sub-band of a first subframe and a second subframe that are of each frame of the stereo audio signal may be obtained.

Optionally, for a processing manner of parsing the stereo audio signal frame by frame to obtain an ICLD of each sub-band of each subframe of each frame, refer to the description in step 101 in FIG. 1, and details are not repeatedly described herein.

Step 202: Calculate, according to the obtained ICLD of each sub-band of each subframe of each frame of the stereo audio signal, a sum of absolute values of the ICLDs of a first subframe of any frame of the stereo audio signal and that of a second subframe of any frame of the stereo audio signal.

Optionally, the sum of the absolute values of the ICLDs of the first subframe of the any frame of the stereo audio signal is calculated according to $$\text{sum}(1) = \sum_{b=1}^{K} \text{level}(b),$$

where b represents any sub-band of the first subframe, and $0<b\leq K$; and K represents a quantity of sub-bands included in any subframe, and $K\geq 12$.

Optionally, sum(2) is calculated according to the method for calculating sum(1), which is not described in detail herein again.

Step 203: Determine whether an absolute value of a difference between the sum of the absolute values of the ICLDs of the first subframe and the sum of the absolute values of the ICLDs of the second subframe is less than a preset threshold.

Optionally, whether the absolute value of the difference between the sum of the absolute values of the ICLDs of the first subframe and the sum of the absolute values of the ICLDs of the second subframe is less than the preset threshold is determined according to $|\text{sum}(1)-\text{sum}(2)|<\text{TH}$, where TH is the preset threshold, and the preset threshold may be set empirically.

Step 204: When the absolute value of the difference between the sum of the absolute values of the ICLDs of the first subframe and the sum of the absolute values of the ICLDs of the second subframe is less than the preset threshold, calculate a weighted ICLD value of each sub-band of the any frame in a first weighting manner.

When $|\text{sum}(1)-\text{sum}(2)|<\text{TH}$, it indicates that the ICLDs of the first subframe are close to the ICLDs of the second subframe, and the weighted ICLD value of each sub-band of the any frame may be calculated in the first weighting manner.

Optionally, this step includes calculating a first weighting factor of a $b^{th}$ sub-band of an $i^{th}$ subframe according to a quantity of subframes included in the any frame, where i represents any subframe included in the any frame, and $0<i\leq L$; L is the quantity of subframes included in the any frame, and $L\geq 2$; b represents any sub-band of the $i^{th}$ subframe, and $0<b\leq K$; and K represents a quantity of sub-bands included in any subframe, and $K\geq 12$; and calculating a weighted ICLD value of the $b^{th}$ sub-band of the any frame according to the first weighting factor and an ICLD of the $b^{th}$ sub-band of the $i^{th}$ subframe of the any frame.

Further, optionally, the calculating a first weighting factor of a $b^{th}$ sub-band of an $i^{th}$ subframe according to a quantity of subframes included in the any frame includes calculating the first weighting factor of the $b^{th}$ sub-band of the $i^{th}$ subframe according to $fac_1(i,b)=/L$ where $fac_1(i,b)$ represents the first weighting factor of the $b^{th}$ sub-band of the $i^{th}$ subframe, and $0<b\leq K$; K represents the quantity of sub-bands included in any subframe, and $K\geq 12$; i represents any subframe included in the any frame, and $0<i\leq L$; and L is the quantity of subframes included in the any frame, and $L\geq 2$.

In this step, L is 2, and the first weighting factor of the first or second subframe of the any frame is $fac_1(i,b)=1/L=0.5$.

Further, optionally, the calculating a weighted ICLD value of the $b^{th}$ sub-band of the any frame according to the first weighting factor and an ICLD of the $b^{th}$ sub-band of the $i^{th}$ subframe of the any frame includes calculating the weighted ICLD value of the $b^{th}$ sub-band of the any frame according to $$\text{level}(b) = \sum_{i=1}^{L} fac_1(i, b) * \text{level}(i, b),$$

where level(b) represents the weighted ICLD value of the $b^{th}$ sub-band of the any frame, and $0<b\leq K$; K represents the quantity of sub-bands included in any subframe, and $K\geq 12$; i represents any subframe included in the any frame, and $0<i\leq L$; and level(i, b) represents the ICLD of the $b^{th}$ sub-band of the $i^{th}$ subframe.

In this step, L=2, and the weighted ICLD value of the any frame is level(b)=[level(1, b)+level(2, b)]*0.5.

Step 205: When an absolute value of a difference between the sums of the absolute values of the ICLDs of any two subframes of the any frame is greater than or equal to a preset threshold, calculate a weighted ICLD value of each sub-band of the any frame in a second weighting manner.

When $|\text{sum}(1)-\text{sum}(2)|\geq TH$, it indicates that the ICLDs of the first subframe are greatly different from the ICLDs of the second subframe, and the weighted ICLD value of each sub-band of the any frame may be calculated in the second weighting manner.

Optionally, three following manners may be used to calculate the weighted ICLD value of each sub-band of the any frame in the second weighting manner. Manner 1 is performing weighting processing on the entire frame; Manner 2 is performing, based on a current sub-band, weighting processing sub-band by sub-band; and Manner 3 is performing, based on M adjacent sub-bands, weighting processing sub-band by sub-band.

Optionally, when Manner 1 is used to perform the weighting processing, this step includes calculating a second weighting factor of a $b^{th}$ sub-band of the first or second subframe according to the calculated sum of the absolute values of the ICLDs of the first or second subframe of the any frame of the stereo audio signal; and calculating a weighted ICLD value of the $b^{th}$ sub-band of the any frame according to the second weighting factor and the ICLD of the $b^{th}$ sub-band of the first or second subframe included in the any frame.

Optionally, the calculating a second weighting factor of a $b^{th}$ sub-band of the first or second subframe according to the calculated sum of the absolute values of the ICLDs of the first or second subframe of the any frame of the stereo audio signal includes calculating the second weighting factor of the $b^{th}$ sub-band of the $i^{th}$ subframe according to $$fac_2(i, b) = \text{sum}(i) \Big/ \sum_{j=1}^{L} \text{sum}(j),$$

where $fac_2(i,b)$ is the second weighting factor of the $b^{th}$ sub-band of the $i^{th}$ subframe, sum(i) represents a sum of absolute values of ICLDs of all sub-bands of the $i^{th}$ subframe, sum(j) represents a sum of absolute values of ICLDs of all sub-bands of a $j^{th}$ subframe, j is any subframe included in the any frame, and $0<j\leq L$.

In this step, i=1 or 2, and $fac_2=\text{sum}(1)/[\text{sum}(1)+\text{sum}(2)]$.

Further, optionally, the calculating a weighted ICLD value of the $b^{th}$ sub-band of the any frame according to the second weighting factor and the ICLD of the $b^{th}$ sub-band of the first or second subframe included in the any frame includes calculating the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, $fac_2(i,b)$ is the second weighting factor of the $b^{th}$ sub-band of the $i^{th}$ subframe, and level(i, b) represents the ICLD of the $b^{th}$ sub-band of the $i^{th}$ subframe.

In this step, the weighted ICLD value of the $b^{th}$ sub-band of the any frame is $\text{level}(b)=fac_2*\text{level}(1, b)+(1-fac_2)*\text{level}(2, b)$.

Optionally, when Manner 2 is used to perform the weighting processing, this step includes calculating a second weighting factor of a $b^{th}$ sub-band of the first or second subframe according to the calculated ICLD of the $b^{th}$ sub-band of the first or second subframe included in the any frame of the stereo audio signal; and calculating a weighted ICLD value of the $b^{th}$ sub-band of the any frame according to the second weighting factor and the ICLD of the $b^{th}$ sub-band of the first or second subframe included in the any frame.

Further, optionally, the calculating a second weighting factor of a $b^{th}$ sub-band of the first or second subframe according to the calculated ICLD of the $b^{th}$ sub-band of the first or second subframe of the any frame of the stereo audio signal includes calculating the second weighting factor of the $b^{th}$ sub-band of the $i^{th}$ subframe according to $$fac_2(i, b) = |\text{level}(i, b)| \Big/ \sum_{j=1}^{L} |\text{level}(j, b)|,$$

where level(i, b) represents the ICLD of the $b^{th}$ sub-band of the $i^{th}$ subframe, and level(j, b) represents an ICLD of a $b^{th}$ sub-band of a $j^{th}$ subframe.

In this step, i=1 or 2, and $fac_2(b)=\text{level}(1,b)/[\text{level}(1,b)+\text{level}(2,b)]$.

Optionally, the calculating a weighted ICLD value of the $b^{th}$ sub-band of the any frame according to the second weighting factor and the ICLD of the $b^{th}$ sub-band of the first or second subframe included in the any frame includes calculating the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, and $0<b\leq K$; K represents a quantity of sub-bands included in any subframe, and $K\geq 12$; $fac_2(i,b)$ represents the second weighting factor of the $b^{th}$ sub-band of the $i^{th}$ subframe, and $0<i\leq L$; and level(i, b) represents the ICLD of the $b^{th}$ sub-band of the $i^{th}$ subframe.

In this step, L=2, and the weighted ICLD value of the $b^{th}$ sub-band of the any frame is $\text{level}(b)=fac_2(b)*\text{level}(1, b)+(1-fac_2(b))*\text{level}(2, b)$.

Optionally, when Manner 3 is used to perform the weighting processing, this step includes calculating a second weighting factor of a $b^{th}$ sub-band of the first or second subframe according to the calculated ICLD of the $b^{th}$ sub-band of the first or second subframe included in the any frame of the stereo audio signal; and calculating a weighted ICLD value of the $b^{th}$ sub-band of the any frame according to the second weighting factor and the ICLD of the $b^{th}$ sub-band of the first or second subframe included in the any frame.

Further, optionally, the calculating a second weighting factor of a $b^{th}$ sub-band of the first or second subframe according to the calculated ICLD of the $b^{th}$ sub-band of the first or second subframe included in the any frame of the stereo audio signal includes calculating the second weighting factor of the $b^{th}$ sub-band of the first or second subframe according to $$fac_2(i, b) = \left\{ \begin{array}{ll} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(i, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \leq b \leq K - \lfloor M/2 \rfloor \end{array} \right\},$$

where M represents a quantity of adjacent sub-bands of any subframe of the any frame, and 1 represents a difference between an index number of an adjacent sub-band and an index number of a current sub-band. It should be noted that one subframe may be divided into K sub-bands, such as sub-band 1, sub-band 2, . . . , and sub-band K, where 1, 2, . . . , and K here are index numbers of the sub-bands.

In this step, a weighting factor obtained based on the ICLDs of two adjacent sub-bands is:

$$fac_2(b) = \left\{ \begin{array}{ll} \dfrac{|\text{level}(1, b)|}{|\text{level}(1, b)| + |\text{level}(2, b)|} & b = 1 \\ \dfrac{|\text{level}(1, b)| + |\text{level}(1, b-1)|}{|\text{level}(1, b)| + |\text{level}(1, b-1)| + |\text{level}(2, b)| + |\text{level}(2, b-1)|} & 1 < b \leq K \end{array} \right\}.$$

In this step, a weighting factor obtained based on the ICLDs of three adjacent sub-bands is:

$$fac_2(i, b) = \left\{ \begin{array}{ll} \dfrac{|\text{level}(1, b)|}{|\text{level}(1, b)| + |\text{level}(2, b)|} & b = 1 \text{ or } b = K \\ \dfrac{\sum_{l=-1}^{1} |\text{level}(1, b+l)|}{\sum_{l=-1}^{1} |\text{level}(1, b+l)| + \sum_{l=-1}^{1} |\text{level}(2, b+l)|} & 1 < b < K \end{array} \right\}.$$

It should be noted that when a weighting factor based on the ICLDs of another quantity of, such as four or five, adjacent sub-bands needs to be calculated, calculation may be performed by referring to the foregoing general calculation formula for a weighting factor based on the ICLDs of M sub-bands, which is not described in detail herein again using specific examples.

Optionally, the calculating a weighted ICLD value of the $b^{th}$ sub-band of the first or second subframe according to the second weighting factor and the ICLD of the $b^{th}$ sub-band of the first or second subframe included in the any frame is the same as the method for calculating the weighted ICLD value of the $b^{th}$ sub-band of the any frame in Manner 2, where L=2, that is, the weighted ICLD value of the $b^{th}$ sub-band of the any frame is $\text{level}(b)=fac_2(b)*\text{level}(1, b)+(1-fac_2(b))*\text{level}(2, b)$.

Step 206: Perform quantization processing on the obtained weighted ICLD value.

Optionally, the quantization processing here is acquiring, according to a comparison between a preset codebook and the weighted ICLD value, a value that is in the preset codebook and that is closest to the weighted ICLD value. For example, the weighted ICLD value is 1.4, and the preset codebook includes values such as 0 and 2, such that a value obtained after the quantization processing is performed on the weighted ICLD value is 2.

Further, optionally, to reduce transmitted bits on the premise that quality of decoded stereo audio is ensured, when the quantization processing is performed, a difference between a current weighted ICLD value and a previous weighted ICLD value may be calculated and the quantization processing is performed on the calculated difference. For example, one subframe is divided into 15 sub-bands, the quantization processing is directly performed on a weighted ICLD value of a first sub-band; when the quantization processing is performed on a weighted ICLD value of a second sub-band, a difference between the weighted ICLD value of the second sub-band and the weighted ICLD value of the first sub-band is calculated first, and then the quantization processing is performed on the calculated difference, so as to obtain a quantization result of the weighted ICLD value of the second sub-band. Quantization results of weighted ICLD values of the other sub-bands may be calculated sequentially according to the method for calculating the quantization result of the weighted ICLD value of the second sub-band.

Figure 3:
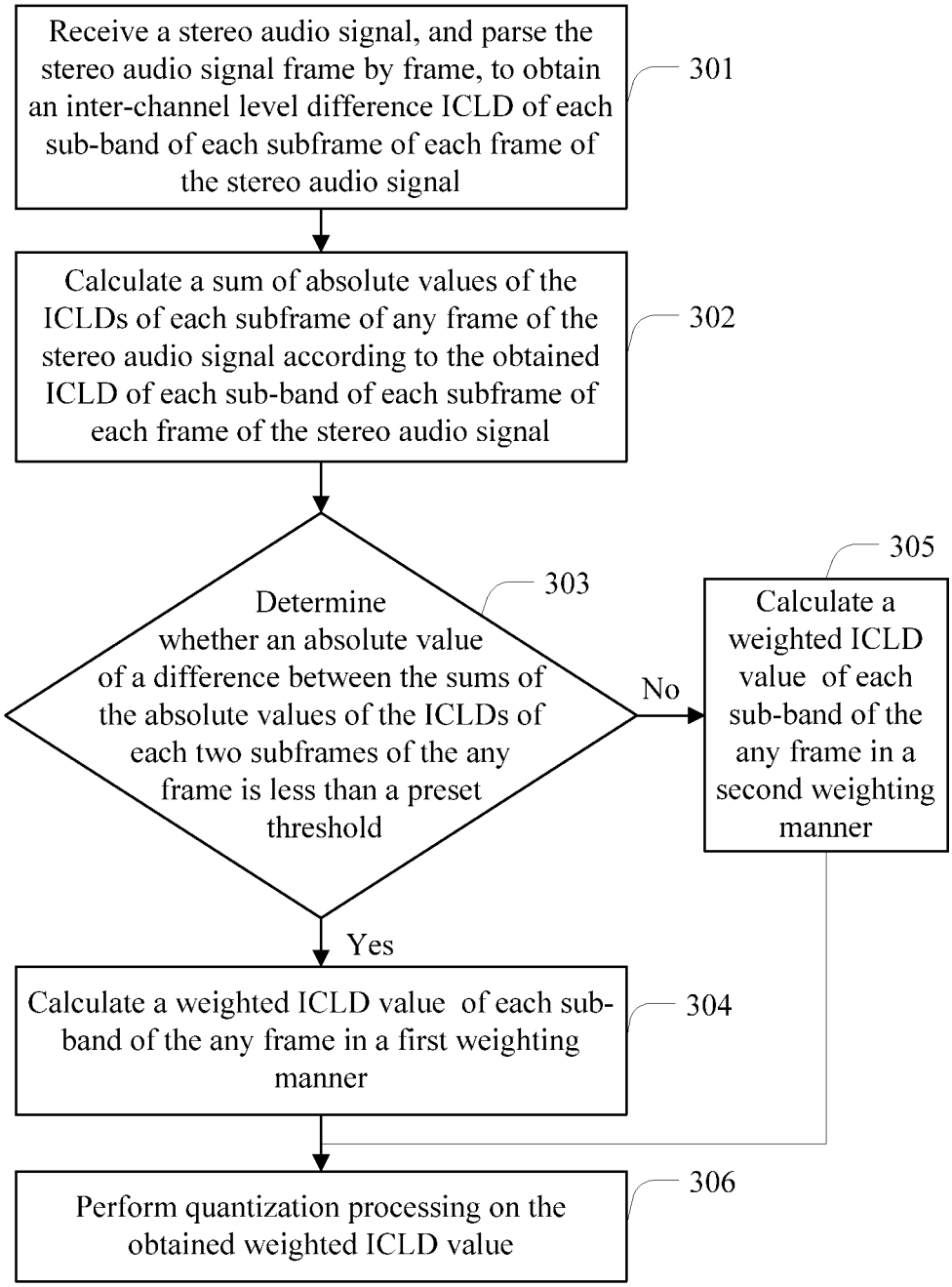
FIG. 3 is a flowchart of an ICLD processing method according to another embodiment of the present disclosure.

That one frame includes four subframes is used in the following for detailed description, and as shown in FIG. 3, the method includes the following steps.

Step 301: Receive a stereo audio signal, and parse the stereo audio signal frame by frame, to obtain an ICLD of each sub-band of each subframe of each frame of the stereo audio signal.

Optionally, each frame includes four subframes. Optionally, for a processing manner of parsing the stereo audio signal frame by frame to obtain an ICLD of each sub-band of each subframe of each frame, refer to the description in step 101 in FIG. 1, and details are not repeatedly described herein.

Step 302: Calculate a sum of absolute values of the ICLDs of each subframe of any frame of the stereo audio signal according to the obtained ICLD of each sub-band of each subframe of each frame of the stereo audio signal.

Optionally, the sum of the absolute values of the ICLDs of a first subframe of the any frame of the stereo audio signal is calculated according to $$\text{sum}(i) = \sum_{b=1}^{K} \text{level}(b),$$

where b represents any sub-band of the first subframe, and $0<b\leq K$; K represents a quantity of sub-bands included in any subframe, and $K\geq 12$; and i represents any subframe included in the any frame, and in this embodiment, $0<i\leq 4$.

Step 303: Determine whether an absolute value of a difference between the sums of the absolute values of the ICLDs of each two subframes of the any frame is less than a preset threshold.

Optionally, whether the absolute value of the difference between the sum of the absolute values of the ICLDs of an $i^{th}$ subframe and that of a $j^{th}$ subframe of the any frame is less than the preset threshold is determined according to $|\text{sum}(i)-\text{sum}(j)|<TH$, where TH is the preset threshold, and the preset threshold may be set empirically.

Step 304: When the absolute value of the difference between the sums of the absolute values of the ICLDs of each two subframes of the any frame is less than the preset threshold, calculate a weighted ICLD value of each sub-band of the any frame in a first weighting manner.

When $|\text{sum}(i)-\text{sum}(j)|<TH$, it indicates that the ICLDs of the $i^{th}$ subframe are close to the ICLDs of the $j^{th}$ subframe, and the weighted ICLD value of each sub-band of the any frame is calculated in the first weighting manner.

Optionally, this step includes calculating a first weighting factor of a $b^{th}$ sub-band of an $i^{th}$ subframe according to a quantity of subframes included in the any frame, where i represents any subframe included in the any frame, and $0<i\leq L$; L is the quantity of subframes included in the any frame, and $L\geq 2$; b represents any sub-band of the $i^{th}$ subframe, and $0<b\leq K$; and K represents a quantity of sub-bands included in any subframe, and $K\geq 12$; and calculating a weighted ICLD value of the $b^{th}$ sub-band of the any frame according to the first weighting factor and an ICLD of the $b^{th}$ sub-band of the $i^{th}$ subframe of the any frame.

Further, optionally, the calculating a first weighting factor of a $b^{th}$ sub-band of an $i^{th}$ subframe according to a quantity of subframes included in the any frame includes calculating the first weighting factor of the $b^{th}$ sub-band of the $i^{th}$ subframe according to $fac_1(i,b)=1/L$, where $fac_1(i,b)$ represents the first weighting factor of the $b^{th}$ sub-band of the $i^{th}$ subframe, and $0<b\leq K$; K represents the quantity of sub-bands included in any subframe, and $K\geq 12$; i represents any subframe included in the any frame, and $0<i\leq L$; and L is the quantity of subframes included in the any frame, and $L\geq 2$.

In this step, L=4, and the first weighting factor is $fac_1(i,b)=1/L=0.25$.

Further, optionally, the calculating a weighted ICLD value of the $b^{th}$ sub-band of the any frame according to the first weighting factor and an ICLD of the $b^{th}$ sub-band of the $i^{th}$ subframe of the any frame includes calculating the weighted ICLD value of the $b^{th}$ sub-band of the any frame according to $$\text{level}(b) = \sum_{i=1}^{L} fac_1(i, b) * \text{level}(i, b),$$

where level(b) represents the weighted ICLD values of the $b^{th}$ sub-bands of the any two subframes, and $0<b\leq K$; K represents the quantity of sub-bands included in any subframe, and $K\geq 12$; i represents any subframe included in the any frame, and $0<i\leq L$; and level(i, b) represents the ICLD of the $b^{th}$ sub-band of the $i^{th}$ subframe.

In this step, the weighted ICLD value of the $b^{th}$ sub-band of the any frame is $$\text{level}(b) = 0.25 * \sum_{i=1}^{4} \text{level}(i, b).$$

Step 305: When the absolute value of the difference between the sums of the absolute values of the ICLDs of any two subframes of the any frame is greater than or equal to the preset threshold, calculate a weighted ICLD value of each sub-band of the any frame in a second weighting manner.

When $|\text{sum}(i)-\text{sum}(j)|\geq TH$, it indicates that the ICLDs of the $i^{th}$ subframe are greatly different from the ICLDs of the $j^{th}$ subframe, and the weighted ICLD value of each sub-band of the any frame may be calculated in the second weighting manner. It should be noted that, that the absolute value of the difference between the sums of the absolute values of the ICLDs of any two subframes included in the any frame is greater than or equal to the preset threshold can be construed as: absolute values of all differences are greater than or equal to the preset threshold; or absolute values of some differences are less than the preset threshold, and absolute values of the other differences are greater than or equal to the preset threshold. For example, when $|\text{sum}(1)-\text{sum}(2)|\geq TH$, $|\text{sum}(1)-\text{sum}(3)|\geq TH$, $|\text{sum}(1)-\text{sum}(4)|\geq TH$, $|\text{sum}(2)-\text{sum}(3)|\geq TH$, $|\text{sum}(2)-\text{sum}(4)|\geq TH$, and $|\text{sum}(3)-\text{sum}(4)|\geq TH$; or when $|\text{sum}(1)-\text{sum}(2)|\geq TH$, $|\text{sum}(1)-\text{sum}(3)|\geq TH$, $|\text{sum}(1)-\text{sum}(4)<TH$, $|\text{sum}(2)-\text{sum}(3)|<TH$, $|\text{sum}(2)-\text{sum}(4)|<TH$, and $|\text{sum}(3)-\text{sum}(4)|<TH$, the weighted ICLD value of any sub-band of the any frame may be calculated in the second weighting manner.

Optionally, three following manners may be used to calculate the weighted ICLD value of each sub-band of the any frame in the second weighting manner. Manner 1 is performing weighting processing on the entire frame; Manner 2 is performing, based on a current sub-band, weighting processing sub-band by sub-band; and Manner 3 is performing, based on M adjacent sub-bands, weighting processing sub-band by sub-band.

Optionally, when Manner 1 is used to perform the weighting processing, this step includes calculating a second weighting factor of a $b^{th}$ sub-band of the $i^{th}$ subframe according to the calculated sum of the absolute values of the ICLDs of each subframe of the any frame of the stereo audio signal, where i represents any subframe included in the any frame, and $0<i\leq L$; L is a quantity of subframes included in the any frame, and $L\geq 2$; b represents any sub-band of the $i^{th}$ subframe, and $0<b\leq K$; and K represents a quantity of sub-bands included in any subframe, and K≥12; and calculating a weighted ICLD value of the $b^{th}$ sub-band of the any frame according to the second weighting factor and the ICLD of the $b^{th}$ sub-band of the $i^{th}$ subframe of the any frame.

Optionally, the calculating a second weighting factor of a $b^{th}$ sub-band of the $i^{th}$ subframe according to the calculated sum of the absolute values of the ICLDs of each subframe of the any frame of the stereo audio signal includes calculating the second weighting factor of the $b^{th}$ sub-band of the $i^{th}$ subframe according to $$fac_2(i, b) = \text{sum}(i) \Big/ \sum_{j=1}^{L} \text{sum}(j),$$

where $fac_2(i,b)$ is the second weighting factor of the $b^{th}$ sub-band of the $i^{th}$ subframe, sum(i) represents a sum of absolute values of ICLDs of all sub-bands of the $i^{th}$ subframe, sum(j) represents a sum of absolute values of ICLDs of all sub-bands of a $j^{th}$ subframe, j is any subframe included in the any frame, and $0<j\leq L$.

Further, optionally, in this step, L=4, and the second weighting factor of the $b^{th}$ sub-band of the $i^{th}$ subframe is calculated according to $$fac_2(i, b) = \text{sum}(i) \Big/ \sum_{j=1}^{4} \text{sum}(j).$$

Further, optionally, the calculating a weighted ICLD value of the $b^{th}$ sub-band of the any frame according to the second weighting factor and the ICLD of the $b^{th}$ sub-band of the $i^{th}$ subframe of the any frame includes calculating the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, $fac_2(i,b)$ is the second weighting factor of the $b^{th}$ sub-band of the $i^{th}$ subframe, and level(i, b) represents the ICLD of the $b^{th}$ sub-band of the $i^{th}$ subframe.

Further, optionally, in this step, L=4, and the weighted ICLD value of the $b^{th}$ sub-band of the any frame is calculated according to $$\text{level}(b) = \sum_{i=1}^{4} fac_2(i, b) * \text{level}(i, b).$$

Optionally, when Manner 2 is used to perform the weighting processing, this step includes calculating a second weighting factor of a $b^{th}$ sub-band of the $i^{th}$ subframe according to an ICLD of the $b^{th}$ sub-band of the $i^{th}$ subframe of the any frame; and calculating a weighted ICLD value of the $b^{th}$ sub-band of the any frame according to the second weighting factor and the ICLD of the $b^{th}$ sub-band of the $i^{th}$ subframe of the any frame.

Further, optionally, the calculating a second weighting factor of a $b^{th}$ sub-band of the $i^{th}$ subframe according to an ICLD of the $b^{th}$ sub-band of the $i^{th}$ subframe of the any frame includes calculating the second weighting factor of the $b^{th}$ sub-band of the $i^{th}$ subframe according to $$fac_2(i, b) = |\text{level}(i, b)| \Big/ \sum_{j=1}^{L} |\text{level}(j, b)|,$$

where level(i, b) represents the ICLD of the $b^{th}$ sub-band of the $i^{th}$ subframe, and level(j, b) represents an ICLD of a $b^{th}$ sub-band of a $j^{th}$ subframe.

Further, optionally, in this step, L=4, and the second weighting factor of the $b^{th}$ sub-band of the $i^{th}$ subframe is calculated according to $$fac_2(i, b) = |\text{level}(i, b)| \Big/ \sum_{j=1}^{4} |\text{level}(j, b)|.$$

Optionally, the calculating a weighted ICLD value of the $b^{th}$ sub-band of the any frame according to the second weighting factor and the ICLD of the $b^{th}$ sub-band of the $i^{th}$ subframe of the any frame includes calculating the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, and $0<b\leq K$; K represents a quantity of sub-bands included in any subframe, and K≥12; $fac_2(i,b)$ is the second weighting factor of the $b^{th}$ sub-band of the $i^{th}$ subframe, and $0<i\leq L$; and level(i, b) represents the ICLD of the $b^{th}$ sub-band of the $i^{th}$ subframe.

Further, optionally, in this step, the weighted ICLD value of the $b^{th}$ sub-band of the any frame is calculated according to $$\text{level}(b) = \sum_{i=1}^{4} fac_2(i, b) * \text{level}(i, b).$$

Optionally, when Manner 3 is used to perform the weighting processing, this step includes calculating a second weighting factor of a $b^{th}$ sub-band of the $i^{th}$ subframe according to an ICLD of the $b^{th}$ sub-band of the $i^{th}$ subframe of the any frame; and calculating a weighted ICLD value of the $b^{th}$ sub-band of the any frame according to the second weighting factor and the ICLD of the $b^{th}$ sub-band of the $i^{th}$ subframe of the any frame.

Further, optionally, the calculating a second weighting factor of a $b^{th}$ sub-band of the $i^{th}$ subframe according to an ICLD of the $b^{th}$ sub-band of the $i^{th}$ subframe of the any frame includes calculating the second weighting factor of the $b^{th}$ sub-band of the $i^{th}$ subframe according to $$fac_2(i, b) = \begin{cases} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(i, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \le b \le K - \lfloor M/2 \rfloor \end{cases},$$

where M represents a quantity of adjacent sub-bands of any subframe of the any frame, and l represents a difference between an index number of an adjacent sub-band and an index number of a current sub-band. It should be noted that one subframe may be divided into K sub-bands, such as sub-band 1, sub-band 2, . . . , and sub-band K, where 1, 2, . . . , and K here are index numbers of the sub-bands.

Further, optionally, in this step, the second weighting factor of the $b^{th}$ sub-band of the $i^{th}$ subframe is calculated based on the ICLDs of two adjacent sub-bands and according to:

$$fac_2(i, b) = \begin{cases} \dfrac{|\text{level}(i, b)|}{\sum_{j=1}^{4} |\text{level}(j, b)|} & b = 1 \\ \dfrac{|\text{level}(i, b)| + |\text{level}(i, b-1)|}{\sum_{j=1}^{4} |\text{level}(j, b)| + |\text{level}(j, b-l)|} & 1 < b \le K \end{cases}$$

Further, optionally, in this step, the second weighting factor of the $b^{th}$ sub-band of the $i^{th}$ subframe is calculated based on the ICLDs of three adjacent sub-bands and according to:

$$fac_2(i, b) = \begin{cases} \dfrac{|\text{level}(i, b)|}{\sum_{j=1}^{4} |\text{level}(j, b+)|} & b = 1 \text{ or } b = K \\ \dfrac{\sum_{l=-1}^{1} |\text{Level}(i, b+l)|}{\sum_{j=1}^{4} \sum_{l=1}^{1} |\text{level}(j, b+l)|} & 1 < b < K \end{cases}.$$

It should be noted that when a weighting factor based on the ICLDs of another quantity of, such as four or five, adjacent sub-bands needs to be calculated, calculation may be performed by referring to the foregoing general calculation formula for a weighting factor based on the ICLDs of M sub-bands, which is not described in detail herein again using specific examples. The weighted ICLD value of the $b^{th}$ sub-band of the any frame is calculated according to the second weighting factor and the ICLD of the $b^{th}$ sub-band of the $i^{th}$ subframe of the any frame.

Optionally, the calculating a weighted ICLD value of the $b^{th}$ sub-band of the any frame according to the second weighting factor and the ICLD of the $b^{th}$ sub-band of the $i^{th}$ subframe of the any frame is the same as the method for calculating the weighted ICLD value of the $b^{th}$ sub-band of the any frame in Manner 2, that is, the weighted ICLD value of the $b^{th}$ sub-band of the any frame is $$\text{level}(b) = \sum_{i=1}^{4} fac_2(i, b) * \text{level}(i, b).$$

Step 306: Perform quantization processing on the obtained weighted ICLD value.

Optionally, the quantization processing here is acquiring, according to a comparison between a preset codebook and the weighted ICLD value, a value that is in the preset codebook and that is closest to the weighted ICLD value. For example, the weighted ICLD value is 1.4, and the preset codebook includes values such as 0 and 2, such that a value obtained after the quantization processing is performed on the weighted ICLD value is 2.

Further, optionally, to reduce transmitted bits on the premise that quality of decoded stereo audio is ensured, when the quantization processing is performed, a difference between a current weighted ICLD value and a previous weighted ICLD value may be calculated and the quantization processing is performed on the calculated difference. For example, one subframe is divided into 15 sub-bands, the quantization processing is directly performed on a weighted ICLD value of a first sub-band; when the quantization processing is performed on a weighted ICLD value of a second sub-band, a difference between the weighted ICLD value of the second sub-band and the weighted ICLD value of the first sub-band is calculated first, and then the quantization processing is performed on the calculated difference, so as to obtain a quantization result of the weighted ICLD value of the second sub-band. Quantization results of weighted ICLD values of the other sub-bands may be calculated sequentially according to the method for calculating the quantization result of the weighted ICLD value of the second sub-band.

It should be noted that when one frame of a stereo audio signal is divided into two subframes, one subframe is divided into 12 sub-bands, and no packet loss occurs during a stereo audio signal transmission process, a segmental signal-to-noise ratio (SSNR) obtained in the prior art is 3.63 decibels (dB), but after the method provided by this embodiment of the present disclosure is used, an obtained SSNR is 3.73 dB. It should be noted that a greater SSNR value means that audio after encoding and decoding processing is closer to original audio, that is, to better effect. Therefore, compared with the prior art, the method provided by this embodiment of the present disclosure increases the SSNR by more than 0.1 dB. When packet loss occurs in a stereo audio signal transmission process, an SSNR obtained in the prior art is 3.59 dB, but after the method provided by this embodiment of the present disclosure is used, an obtained SSNR is 3.72 dB, a test result close to the test result obtained in the case that no packet loss occurs.

According to the ICLD processing method provided by this embodiment of the present disclosure, based on relevance between subframes, weighting processing is performed on an ICLD of any subframe, and quantization processing is performed on a weighted ICLD value, such that an encoded bit rate can be effectively reduced, and quality of decoded stereo audio can be ensured in a case that a signal changes quickly and in a case of packet loss, thereby achieving an expected effect.

Figure 4:
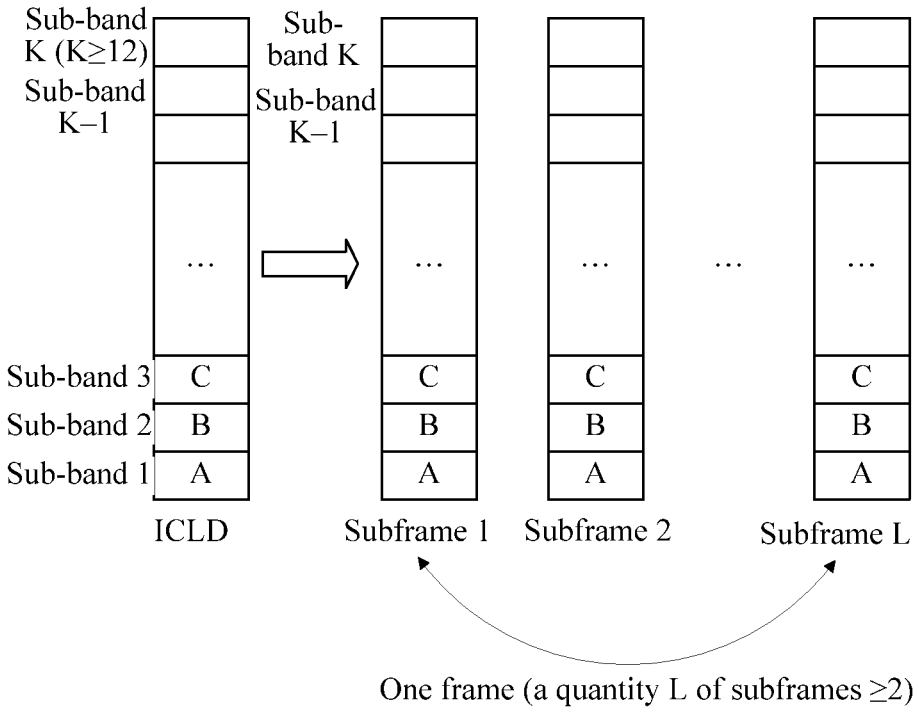
FIG. 4 is a flowchart of another ICLD processing method according to another embodiment of the present disclosure.

An embodiment of the present disclosure provides an ICLD processing method. As shown in FIG. 4, at a stereo audio decoder, an input stereo audio bit stream after quantization processing is received, the bit stream is parsed to obtain ICLDs of K (K≥12) sub-bands, the ICLD value of each sub-band is correspondingly used, in sequence, as an ICLD of each sub-band of each current subframe, so as to obtain a decoded stereo audio signal.

For example, after a received bit stream is parsed, an obtained ICLD of sub-band 1 is A, an obtained ICLD of sub-band 2 is B, an obtained ICLD of sub-band 3 is C, and the like. A current frame is divided into L subframes, and an ICLD of sub-band 1 of each subframe is A, an ICLD of sub-band 2 of each subframe is B, and an ICLD of sub-band 3 of each subframe is C, and the like.

According to the ICLD processing method provided by this embodiment of the present disclosure, after a received stereo audio bit stream after quantization processing is decoded, stereo audio of relatively high quality may be obtained, and low bit-rate transmission of a stereo audio signal is implemented.

Figure 5:
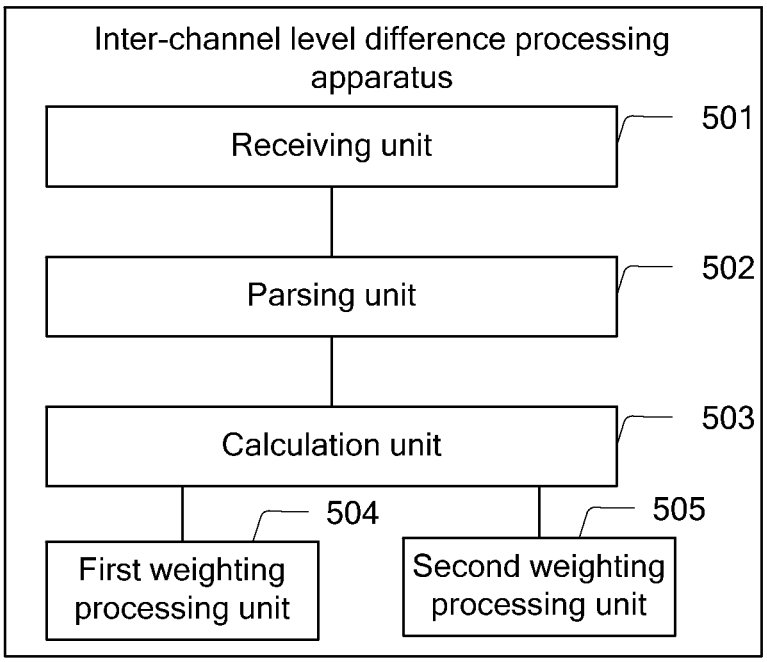
FIG. 5 is a block diagram of an ICLD processing apparatus according to an embodiment of the present disclosure.

An embodiment of the present disclosure provides an ICLD processing apparatus, where the apparatus may be an encoder that processes stereo audio. As shown in FIG. 5, the apparatus includes a receiving unit 501, a parsing unit 502, a calculation unit 503, a first weighting processing unit 504, and a second weighting processing unit 505.

The receiving unit 501 is configured to receive a stereo audio signal.

The parsing unit 502 is configured to parse the stereo audio signal frame by frame according to the stereo audio signal received by the receiving unit 501, to obtain an ICLD of each sub-band of each subframe of each frame of the stereo audio signal, where each frame includes at least two subframes.

The stereo audio signal may be constituted by many frames. In this embodiment, each frame may be further divided into multiple subframes, and each subframe may be divided into multiple sub-bands. It should be noted that, in an actual application, each frame includes an even quantity of subframes, and each frame may include at least two subframes. For example, one frame includes two subframes, or one frame includes four subframes, or one frame includes six subframes. Each subframe includes at least 12 sub-bands.

The ICLD is used to distinguish a horizontal angle of a stereo audio source and describes an intensity difference between audio channels, and this parameter affects frequency components of an entire frequency spectrum.

The calculation unit 503 is configured to calculate a sum of absolute values of the ICLDs of each subframe of any frame of the stereo audio signal according to the ICLD that is of each sub-band of each subframe of each frame of the stereo audio signal and that is obtained by parsing by the parsing unit 502.

The first weighting processing unit 504 is configured to, when an absolute value of a difference between the sums of the absolute values of the ICLDs of each two subframes of the any frame is less than a preset threshold, calculate a weighted ICLD value of each sub-band of the any frame in a first weighting manner.

The second weighting processing unit 505 is configured to, when an absolute value of a difference between the sums of the absolute values of the ICLDs of any two subframes of the any frame is greater than or equal to the preset threshold, calculate a weighted ICLD value of each sub-band of the any frame in a second weighting manner. It should be noted that, that an absolute value of a difference between the sums of the absolute values of the ICLDs of any two subframes included in the any frame is greater than or equal to a preset threshold can be construed as: absolute values of all differences are greater than or equal to the preset threshold; or absolute values of some differences are less than the preset threshold, and absolute values of the other differences are greater than or equal to the preset threshold.

Further, optionally, after the calculation unit 503 calculates the sum of the absolute values of the ICLDs of each subframe of the any frame of the stereo audio signal according to the ICLD that is of each sub-band of each subframe of each frame of the stereo audio signal and that is obtained by parsing by the parsing unit, and before the first weighting processing unit 504 calculates the weighted ICLD value of each sub-band of the any frame in the first weighting manner when the absolute value of the difference between the sums of the absolute values of the ICLDs of each two subframes of the any frame is less than the preset threshold, or before the second weighting processing unit 505 calculates the weighted ICLD value of each sub-band of the any frame in the second weighting manner when the absolute value of the difference between the sums of the absolute values of the ICLDs of any two subframes of the any frame is greater than or equal to the preset threshold, it may be determined first whether the absolute value of the difference between the sums of the absolute values of the ICLDs of each two subframes of the any frame is less than the preset threshold.

Figure 6:
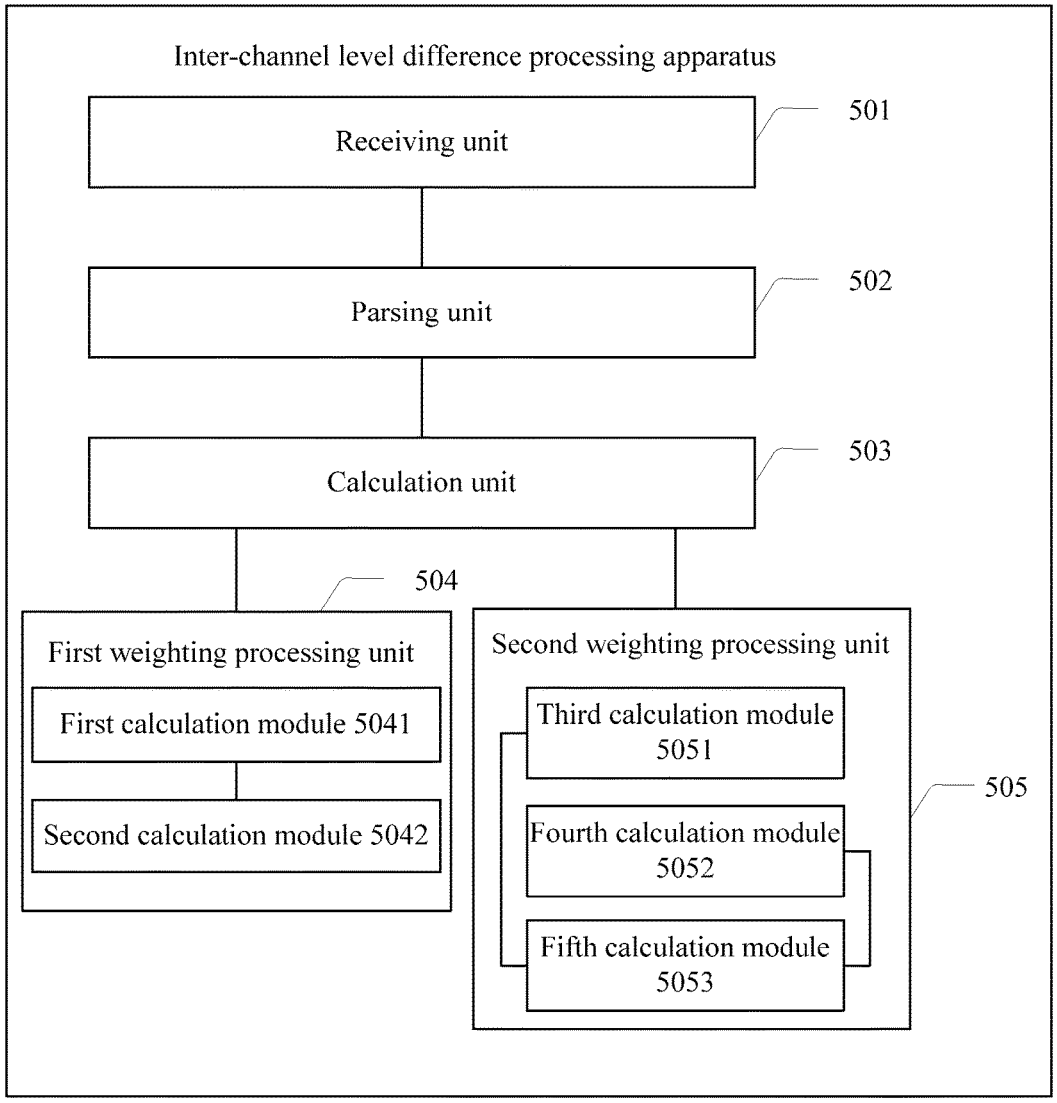
FIG. 6 is a block diagram of another ICLD processing apparatus according to an embodiment of the present disclosure.

Further, optionally, as shown in FIG. 6, the first weighting processing unit 504 includes a first calculation module 5041 and a second calculation module 5042.

The first calculation module 5041 is configured to calculate a first weighting factor of a $b^{th}$ sub-band of an $i^{th}$ subframe according to a quantity of subframes included in the any frame, where i represents any subframe included in the any frame, and $0<i\leq L$; L is the quantity of subframes included in the any frame, and $L\geq 2$; b represents any sub-band of the $i^{th}$ subframe, and $0<b\leq K$; and K represents a quantity of sub-bands included in any subframe, and $K\geq 12$.

The first calculation module 5041 is configured to calculate the first weighting factor of the $b^{th}$ sub-band of the $i^{th}$ subframe according to $fac_1(i,b)=1/L$, where $fac_1(i,b)$ represents the first weighting factor of the $b^{th}$ sub-band of the $i^{th}$ subframe.

The second calculation module 5042 is configured to calculate a weighted ICLD value of the $b^{th}$ sub-band of the any frame according to the first weighting factor and an ICLD of the $b^{th}$ sub-band of the $i^{th}$ subframe of the any frame.

The second calculation module 5042 is configured to calculate the weighted ICLD value of the $b^{th}$ sub-band of the any frame according to $$\text{level}(b) = \sum_{i=1}^{L} fac_1(i, b) * \text{level}(i, b),$$

where level(b) represents the weighted ICLD value of the $b^{th}$ sub-band of the any frame, and level(i, b) represents the ICLD of the $b^{th}$ sub-band of the $i^{th}$ subframe.

Further, optionally, the second weighting processing unit 505 includes a third calculation module 5051, a fourth calculation module 5052, and a fifth calculation module 5053.

The third calculation module 5051 is configured to calculate a second weighting factor of a $b^{th}$ sub-band of an $i^{th}$ subframe according to the calculated sum of the absolute values of the ICLDs of each subframe of the any frame of the stereo audio signal, where i represents any subframe included in the any frame, and $0<i\leq L$; L is a quantity of subframes included in the any frame, and $L\geq 2$; b represents any sub-band of the $i^{th}$ subframe, and $0<b\leq K$; and K represents a quantity of sub-bands included in any subframe, and $K\geq 12$; or the fourth calculation module 5052 is configured to calculate a second weighting factor of a $b^{th}$ sub-band of an $i^{th}$ subframe according to an ICLD of the $b^{th}$ sub-band of the $i^{th}$ subframe of the any frame.

The fifth calculation module 5053 is configured to calculate a weighted ICLD value of the $b^{th}$ sub-band of the any frame according to the second weighting factor and the ICLD of the $b^{th}$ sub-band of the $i^{th}$ subframe of the any frame.

Further, optionally, when the second weighting factor of the $b^{th}$ sub-band of the $i^{th}$ subframe is calculated in a manner of performing weighting processing on the entire frame, the third calculation module 5051 is configured to calculate the second weighting factor of the $b^{th}$ sub-band of the $i^{th}$ subframe according to $$fac_2(i, b) = \text{sum}(i) \Big/ \sum_{j=1}^{L} \text{sum}(j),$$

where $fac_2(i,b)$ is the second weighting factor of the $b^{th}$ sub-band of the $i^{th}$ subframe, sum(i) represents a sum of absolute values of ICLDs of all sub-bands of the $i^{th}$ subframe, sum(j) represents a sum of absolute values of ICLDs of all sub-bands of a $j^{th}$ subframe, j is any subframe included in the any frame, and $0<j\leq L$.

Further, optionally, when the second weighting factor of the $b^{th}$ sub-band of the $i^{th}$ subframe is calculated in a manner of performing, based on the ICLD of a current sub-band, weighting processing sub-band by sub-band, the fourth calculation module 5052 is configured to calculate the second weighting factor of the $b^{th}$ sub-band of the $i^{th}$ subframe according to $$fac_2(i, b) = |\text{level}(i, b)| \Big/ \sum_{j=1}^{L} |\text{level}(j, b)|,$$

where level(i, b) represents the ICLD of the $b^{th}$ sub-band of the $i^{th}$ subframe, and level(j, b) represents an ICLD of a $b^{th}$ sub-band of a $j^{th}$ subframe.

Further, optionally, when the second weighting factor of the $b^{th}$ sub-band of the $i^{th}$ subframe is calculated in a manner of performing, based on the ICLDs of M adjacent sub-bands, weighting processing sub-band by sub-band, the fourth calculation module 5052 is configured to calculate the second weighting factor of the $b^{th}$ sub-band of the $i^{th}$ subframe according to $$fac_2(i, b) = \begin{cases} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(i, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \leq b \leq K - \lfloor M/2 \rfloor \end{cases},$$

where M represents a quantity of adjacent sub-bands, and l represents a difference between an index number of an adjacent sub-band and an index number of a current sub-band. It should be noted that one subframe may be divided into K sub-bands, such as sub-band 1, sub-band 2, . . . , and sub-band K, where 1, 2, . . . , and K here are index numbers of the sub-bands.

Further, optionally, the fifth calculation module 5053 is configured to calculate the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, $fac_2(i,b)$ is the second weighting factor of the $b^{th}$ sub-band of the $i^{th}$ subframe, and level(i, b) represents the ICLD of the $b^{th}$ sub-band of the $i^{th}$ subframe.

It should be noted that, in the apparatus shown in FIG. 5 or FIG. 6, content such as an implementation process of each module and information exchange between modules is based on a same inventive concept as the method embodiments of the present disclosure and may be referred to the method embodiments, which is not described in detail herein again.

It should be noted that when one frame of a stereo audio signal is divided into two subframes, one subframe is divided into 12 sub-bands, and no packet loss occurs during a stereo audio signal transmission process, an SSNR obtained in the prior art is 3.63 dB, but after the apparatus provided by this embodiment of the present disclosure is used, an obtained SSNR is 3.73 dB. It should be noted that a greater SSNR value means that audio after encoding and decoding processing is closer to original audio, that is, to better effect. Therefore, compared with the prior art, the apparatus provided by this embodiment of the present disclosure increases the SSNR by more than 0.1 dB. When packet loss occurs in a stereo audio signal transmission process, an SSNR obtained in the prior art is 3.59 dB, but after the apparatus provided by this embodiment of the present disclosure is used, an obtained SSNR is 3.72 dB, a test result close to the test result obtained in the case that no packet loss occurs.

According to the ICLD processing apparatus provided by this embodiment of the present disclosure, based on relevance between subframes, weighting processing is performed on an ICLD of any subframe, and quantization processing is performed on a weighted ICLD value, such that an encoded bit rate can be effectively reduced, and quality of decoded stereo audio can be ensured in a case that a signal changes quickly and in a case of packet loss, thereby achieving an expected effect.

Figure 7:
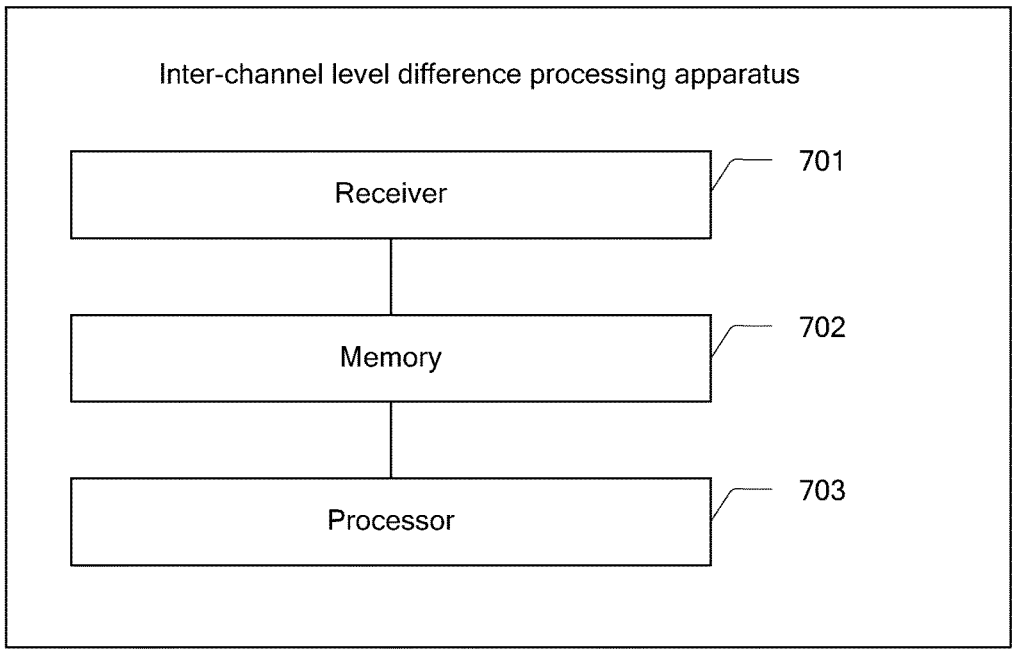
FIG. 7 is a block diagram of another ICLD processing apparatus according to another embodiment of the present disclosure.

An embodiment of the present disclosure provides an ICLD processing apparatus, where the apparatus may be an encoder that processes stereo audio. As shown in FIG. 7, the apparatus includes a receiver 701, a memory 702, and a processor 703.

The receiver 701 is configured to receive a stereo audio signal.

The memory 702 is configured to store information including a program.

The processor 703 is connected to the receiver 701 and the memory 702, and is configured to control execution of the program, which includes parsing the stereo audio signal frame by frame according to the received stereo audio signal, to obtain an ICLD of each sub-band of each subframe of each frame of the stereo audio signal, where each frame includes at least two subframes; calculating a sum of absolute values of the ICLDs of each subframe of any frame of the stereo audio signal according to the ICLD that is of each sub-band of each subframe of each frame of the stereo audio signal and that is obtained by parsing by the parsing unit; and when an absolute value of a difference between the sums of the absolute values of the ICLDs of each two subframes of the any frame is less than a preset threshold, calculating a weighted ICLD value of each sub-band of the any frame in a first weighting manner; or when an absolute value of a difference between the sums of the absolute values of the ICLDs of any two subframes of the any frame is greater than or equal to a preset threshold, calculating a weighted ICLD value of each sub-band of the any frame in a second weighting manner.

It should be noted that, that an absolute value of a difference between the sums of the absolute values of the ICLDs of any two subframes of the any frame is greater than or equal to a preset threshold can be construed as absolute values of all differences are greater than or equal to the preset threshold, or absolute values of some differences are less than the preset threshold, and absolute values of the other differences are greater than or equal to the preset threshold.

Optionally, the stereo audio signal may be constituted by many frames. In this embodiment, each frame may be divided into multiple subframes, and each subframe may be divided into multiple sub-bands. It should be noted that, in an actual application, each frame includes an even quantity of subframes, and each frame may include at least two subframes. For example, one frame includes two subframes, or one frame includes four subframes, or one frame includes six subframes. Each subframe includes at least 12 sub-bands.

The ICLD is used to distinguish a horizontal angle of a stereo audio source and describes an intensity difference between audio channels, and this parameter affects frequency components of an entire frequency spectrum.

Further, optionally, the processor 703 is further configured to, after the sum of the absolute values of the ICLDs of each subframe of the any frame of the stereo audio signal is calculated, and before the weighted ICLD value of each sub-band of the any frame in the first weighting manner is calculated when the absolute value of the difference between the sums of the absolute values of the ICLDs of each two subframes of the any frame is less than the preset threshold, or before the weighted ICLD value of each sub-band of the any frame in the second weighting manner is calculated when the absolute value of the difference between the sums of the absolute values of the ICLDs of any two subframes of the any frame is greater than or equal to the preset threshold, determine whether the absolute value of the difference between the sums of the absolute values of the ICLDs of each two subframes of the any frame is less than the preset threshold.

Further, optionally, when calculating the weighted ICLD value of each sub-band of the any frame in the first weighting manner, the processor 703 is configured to calculate a first weighting factor of a $b^{th}$ sub-band of an $i^{th}$ subframe according to a quantity of subframes included in the any frame, where i represents any subframe included in the any frame, and $0<i\leq L$; L is the quantity of subframes included in the any frame, and $L\geq 2$; b represents any sub-band of the $i^{th}$ subframe, and $0<b\leq K$; and K represents a quantity of sub-bands included in any subframe, and $K\geq 12$; and calculate a weighted ICLD value of the $b^{th}$ sub-band of the any frame according to the first weighting factor and an ICLD of the $b^{th}$ sub-band of the $i^{th}$ subframe of the any frame.

Further, optionally, when calculating the first weighting factor of the $b^{th}$ sub-band of the $i^{th}$ subframe according to the quantity of subframes included in the any frame, the processor 703 is configured to calculate the first weighting factor of the $b^{th}$ sub-band of the $i^{th}$ subframe according to $fac_1(i,b)=1/L$, where $fac_1(i,b)$ represents the first weighting factor of the $b^{th}$ sub-band of the $i^{th}$ subframe.

Further, optionally, when calculating the weighted ICLD value of the $b^{th}$ sub-band of the any frame according to the first weighting factor and an ICLD of the $b^{th}$ sub-band of the $i^{th}$ subframe of the any frame, the processor 703 is configured to calculate the weighted ICLD value of the $b^{th}$ sub-band of the any frame according to $$\text{level}(b) = \sum_{i=1}^{L} fac_1(i, b) * \text{level}(i, b),$$

where level(b) represents the weighted ICLD value of the $b^{th}$ sub-band of the any frame, and level(i, b) represents the ICLD of the $b^{th}$ sub-band of the $i^{th}$ subframe.

Further, optionally, when calculating the weighted ICLD value of each sub-band of the any frame in the second weighting manner, the processor 703 is configured to calculate a second weighting factor of a $b^{th}$ sub-band of the $i^{th}$ subframe according to the calculated sum of the absolute values of the ICLDs of each subframe of the any frame of the stereo audio signal, where i represents any subframe included in the any frame, and $0<i\leq L$; L is a quantity of subframes included in the any frame, and $L\geq 2$; b represents any sub-band of the $i^{th}$ subframe, and $0<b\leq K$; and K represents a quantity of sub-bands included in any subframe, and $K\geq 12$; or calculate a second weighting factor of a $b^{th}$ sub-band of an $i^{th}$ subframe according to an ICLD of the $b^{th}$ sub-band of the $i^{th}$ subframe of the any frame; and calculate a weighted ICLD value of the $b^{th}$ sub-band of the any frame according to the second weighting factor and the ICLD of the $b^{th}$ sub-band of the $i^{th}$ subframe of the any frame.

Further, optionally, when calculating the second weighting factor of the $b^{th}$ sub-band of the $i^{th}$ subframe according to the calculated sum of the absolute values of the ICLDs of each subframe of the any frame of the stereo audio signal, the processor 703 is configured to calculate the second weighting factor of the $b^{th}$ sub-band of the $i^{th}$ subframe according to $$fac_2(i, b) = \text{sum}(i) \Big/ \sum_{j=1}^{L} \text{sum}(j),$$

where $fac_2(i,b)$ is the second weighting factor of the $b^{th}$ sub-band of the $i^{th}$ subframe, sum(i) represents a sum of absolute values of ICLDs of all sub-bands of the $i^{th}$ subframe, sum(j) represents a sum of absolute values of ICLDs of all sub-bands of a $j^{th}$ subframe, j is any subframe included in the any frame, and $0<j\leq L$.

Further, optionally, when calculating the second weighting factor of the $b^{th}$ sub-band of the $i^{th}$ subframe according to the ICLD of the $b^{th}$ sub-band of the $i^{th}$ subframe of the any frame, the processor 703 is configured to calculate the second weighting factor of the $b^{th}$ sub-band of the $i^{th}$ subframe according to $$fac_2(i, b) = |\text{level}(i, b)| \Big/ \sum_{j=1}^{L} |\text{level}(j, b)|,$$

where level(i, b) represents the ICLD of the $b^{th}$ sub-band of the $i^{th}$ subframe, and level(j, b) represents an ICLD of a $b^{th}$ sub-band of a $j^{th}$ subframe.

Further, optionally, when calculating the second weighting factor of the $b^{th}$ sub-band of the $i^{th}$ subframe according to the ICLD of the $b^{th}$ sub-band of the $i^{th}$ subframe of the any frame, the processor 703 is configured to calculate the second weighting factor of the $b^{th}$ sub-band of the $i^{th}$ subframe according to $$fac_2(i, b) = \left\{ \begin{array}{ll} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(i, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \leq b \leq K - \lfloor M/2 \rfloor \end{array} \right\},$$

where M represents a quantity of adjacent sub-bands, and l represents a difference between an index number of an adjacent sub-band and an index number of a current sub-band. It should be noted that one subframe may be divided into K sub-bands, such as sub-band 1, sub-band 2, . . . , and sub-band K, where 1, 2, . . . , and K here are index numbers of the sub-bands.

Further, optionally, when calculating the weighted ICLD value of the $b^{th}$ sub-band of the any frame according to the second weighting factor and the ICLD of the $b^{th}$ sub-band of the $i^{th}$ subframe of the any frame, the processor 703 is configured to calculate the weighted ICLD value of the $b^{th}$ sub-band of the any frame according to $$\text{level}(b) = \sum_{i=1}^{L} fac_2(i, b) * \text{level}(i, b),$$

where level(b) represents the weighted ICLD value of the $b^{th}$ sub-band of the any frame, $fac_2(i,b)$ is the second weighting factor of the $b^{th}$ sub-band of the $i^{th}$ subframe, and level(i, b) represents the ICLD of the $b^{th}$ sub-band of the $i^{th}$ subframe.

It should be noted that, in the apparatus shown in FIG. 7, content such as an implementation process of each module and information exchange between modules is based on a same inventive concept as the method embodiments of the present disclosure and may be referred to the method embodiments, which is not described in detail herein again.

It should be noted that when one frame of a stereo audio signal is divided into two subframes, one subframe is divided into 12 sub-bands, and no packet loss occurs during a stereo audio signal transmission process, an SSNR obtained in the prior art is 3.63 dB, but after the apparatus provided by this embodiment of the present disclosure is used, an obtained SSNR is 3.73 dB. It should be noted that a greater SSNR value means that audio after encoding and decoding processing is closer to original audio, that is, to better effect. Therefore, compared with the prior art, the apparatus provided by this embodiment of the present disclosure increases the SSNR by more than 0.1 dB. When packet loss occurs in a stereo audio signal transmission process, an SSNR obtained in the prior art is 3.59 dB, but after the apparatus provided by this embodiment of the present disclosure is used, an obtained SSNR is 3.72 dB, a test result close to the test result obtained in the case that no packet loss occurs.

It can be seen that, according to the ICLD processing apparatus provided by this embodiment of the present disclosure, based on relevance between subframes, weighting processing is performed on an ICLD of any subframe, and quantization processing is performed on a weighted ICLD value, such that an encoded bit rate can be effectively reduced, and quality of decoded stereo audio can be ensured in a case that a signal changes quickly and in a case of packet loss, thereby achieving an expected effect.

It should be noted that the described apparatus embodiment is merely exemplary. The units described as separate parts may or may not be physically separate, and parts displayed as units may or may not be physical units, may be located in one position, or may be distributed on a plurality of network units. Some or all of the modules may be selected according to actual requirements to achieve the objectives of the solutions of the embodiments. A person of ordinary skill in the art may understand and implement the embodiments of the present disclosure without creative efforts.

Based on the description of the foregoing implementation manners, a person skilled in the art may clearly understand that the present disclosure may be implemented by software in addition to necessary universal hardware, or by dedicated hardware, including a dedicated integrated circuit, a dedicated central processing unit (CPU), a dedicated memory, a dedicated component, and the like. In most circumstances, the former is a preferred implementation manner. Based on such an understanding, the technical solutions of the present disclosure essentially or the part contributing to the prior art may be implemented in a form of a software product. The software product is stored in a readable storage medium, such as a floppy disk, a universal serial bus (USB) flash drive, a removable hard disk, a read-only memory (ROM), a random access memory (RAM), a magnetic disk, or an optical disc of a computer, and includes several instructions for instructing a computer device (which may be a personal computer, a server, a network device, and the like) to perform the methods described in the embodiments of the present disclosure.

The embodiments in this specification are all described in a progressive manner, for same or similar parts in the embodiments, refer to these embodiments, and each embodiment focuses on a difference from other embodiments. Especially, apparatus and system embodiments are basically similar to a method embodiment, and therefore are described briefly; for related parts, refer to partial description in the method embodiment.

The foregoing description is merely implementation manners of the present disclosure, but is not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A method, comprising:

receiving a stereo audio signal, and parsing the stereo audio signal frame by frame, to obtain a sub-band inter-channel level difference (ICLD) of each sub-band of each subframe of each frame of the stereo audio signal, wherein each frame comprises at least two subframes;

calculating a sum of absolute values of the sub-band ICLDs of each subframe of a frame of the stereo audio signal according to the obtained sub-band ICLD of each sub-band of each subframe of the frame;

calculating a weighted ICLD value of each sub-band of the frame according to the sum of absolute values of the sub-band ICLDs of each subframe of the frame; and transmitting stereo audio frame data that is based on the weighted ICLD values of the sub-bands.

2. The method according claim 1, wherein calculating the weighted ICLD value of each sub-band of the frame comprises calculating the weighted ICLD value of each sub-band of the frame in a first weighting manner when an absolute value of a difference between the sums of the absolute values of the sub-band ICLDs of all pairs of subframes of the at least two subframes of the frame is less than a preset threshold.

3. The method according to claim 2, wherein calculating the weighted ICLD value of each sub-band of the frame in the first weighting manner comprises:

calculating a first weighting factor of a $b^{th}$ sub-band of an $i^{th}$ subframe according to a quantity of subframes comprised in the frame, wherein i represents any subframe of the frame, and $0<i\leq L$, wherein L is the quantity of subframes of the frame, and $L\geq 2$, wherein b represents any sub-band of the $i^{th}$ subframe, and $0<b\leq K$, and wherein K represents a quantity of sub-bands of the $i^{th}$ subframe, and $K\geq 12$; and calculating a weighted ICLD value of the $b^{th}$ sub-band of the frame according to the first weighting factor and the sub-band ICLD of the $b^{th}$ sub-band of the $i^{th}$ subframe of the frame.

4. The method according to claim 3, wherein calculating the first weighting factor of the $b^{th}$ sub-band of the $i^{th}$ subframe according to the quantity of subframes comprised in the frame comprises calculating the first weighting factor of the $b^{th}$ sub-band of the $i^{th}$ subframe according to $fac_1(i,b)=1/L$, wherein $fac_1(i,b)$ represents the first weighting factor of the $b^{th}$ sub-band of the $i^{th}$ subframe.

5. The method according to claim 4, wherein calculating the weighted ICLD value of the $b^{th}$ sub-band of the frame according to the first weighting factor and the sub-band ICLD of the $b^{th}$ sub-band of the $i^{th}$ subframe of the frame comprises calculating the weighted ICLD value of the $b^{th}$ sub-band of the frame according to $$\text{level}(b) = \sum_{i=1}^{L} fac_1(i, b) * \text{level}(i, b),$$

wherein level(b) represents the weighted ICLD value of the $b^{th}$ sub-band of the frame, and wherein level(i,b) represents the sub-band ICLD of the $b^{th}$ sub-band of the $i^{th}$ subframe.

6. The method according claim 1, wherein calculating the weighted ICLD value of each sub-band of the frame comprises calculating the weighted ICLD value of each sub-band of the frame in a second weighting manner when an absolute value of a difference between the sums of the absolute values of the sub-band ICLDs of at least one pair of subframes of the at least two subframes of the frame is greater than or equal to a preset threshold.

7. The method according to claim 6, wherein calculating the weighted ICLD value of each sub-band of the frame in the second weighting manner comprises:

calculating a second weighting factor of a $b^{th}$ sub-band of an $i^{th}$ subframe according to one of the calculated sum of the absolute values of the sub-band ICLDs of each subframe of the frame, and the sub-band ICLD of the $b^{th}$ sub-band of the $i^{th}$ subframe of the frame, wherein i represents any subframe of the frame, and $0<i\leq L$, wherein L is a quantity of subframes of the frame, and $L\geq 2$, wherein b represents any sub-band of the $i^{th}$ subframe, and $0<b\leq K$, and wherein K represents a quantity of sub-bands of the $i^{th}$ subframe, and $K\geq 12$; and calculating a weighted ICLD value of the $b^{th}$ sub-band of the frame according to the second weighting factor and the sub-band ICLD of the $b^{th}$ sub-band of the $i^{th}$ subframe of the frame.

8. The method according to claim 7, wherein calculating the second weighting factor of the $b^{th}$ sub-band of the $i^{th}$ subframe according to the calculated sum of the absolute values of the sub-band ICLDs of each subframe of the frame comprises calculating the second weighting factor of the $b^{th}$ sub-band of the $i^{th}$ subframe according $$fac_2(i, b) = \text{sum}(i) \Big/ \sum_{j=1}^{L} \text{sum}(j),$$

to wherein $fac_2(i,b)$ is the second weighting factor of the $b^{th}$ sub-band of the $i^{th}$ subframe, wherein sum(i) represents a sum of absolute values of sub-band ICLDs of all sub-bands of the $i^{th}$ subframe, wherein sum(j) represents a sum of absolute values of sub-band ICLDs of all sub-bands of a $j^{th}$ subframe, and wherein j is any subframe of the frame, and $0<j\leq L$.

9. The method according to claim 7, wherein calculating the second weighting factor of the $b^{th}$ sub-band of the $i^{th}$ subframe according to the sub-band ICLD of the $b^{th}$ sub-band of the $i^{th}$ subframe of the frame comprises calculating the second weighting factor of the $b^{th}$ sub-band of the $i^{th}$ subframe according to $$fac_2(i, b) = |\text{level}(i, b)| \Big/ \sum_{j=1}^{L} |\text{level}(j, b)|,$$

wherein $fac_2(i,b)$ is the second weighting factor of the $b^{th}$, sub-band of the $i^{th}$ subframe, wherein level(i, b) represents the sub-band ICLD of the $b^{th}$ sub-band of the $i^{th}$ subframe, and wherein level(j, b) represents a sub-band ICLD of the $b^{th}$ sub-band of a $j^{th}$ subframe.

10. The method according to claim 9, wherein calculating the second weighting factor of the $b^{th}$ sub-band of the $i^{th}$ subframe according to the sub-band ICLD of the $b^{th}$ sub-band of the $i^{th}$ subframe of the frame comprises calculating the second weighting factor of the $b^{th}$ sub-band of the $i^{th}$ subframe according to $$fac_2(i,b) = \left\{ \begin{array}{ll} \dfrac{|\text{level}(i,b)|}{\sum_{j=1}^{L} |\text{level}(j,b)|} & b < \lceil M/2 \rfloor \text{ or } b > K - \lfloor M/2 \rfloor \\ \dfrac{\sum_{l=-\lceil M/2 \rceil+1}^{\lfloor M/2 \rfloor} |\text{level}(i,b+l)|}{\sum_{j=1}^{L} \sum_{l=-\lceil M/2 \rceil+1}^{\lfloor M/2 \rfloor} |\text{level}(j,b+l)|} & \lceil M/2 \rfloor \le b \le K - \lfloor M/2 \rfloor \end{array} \right\},$$

wherein M represents a quantity of adjacent sub-bands, and wherein l represents a difference between an index number of an adjacent sub-band and an index number of a current sub-band.

11. The method according to claim 7, wherein calculating the weighted ICLD value of the $b^{th}$ sub-band of the frame according to the second weighting factor and the ICLD of the $b^{th}$ sub-band of the $i^{th}$ subframe of the frame comprises calculating the weighted ICLD value of the $b^{th}$ sub-band of the frame according to $$\text{level}(b) = \sum_{i=1}^{L} fac_2(i,b) * \text{level}(i,b),$$

wherein level(b) represents the weighted ICLD value of the $b^{th}$ sub-band of the frame, wherein $fac_2(i,b)$ is the second weighting factor of the $b^{th}$ sub-band of the $i^{th}$ subframe, and wherein level(i, b) represents the sub-band ICLD of the $b^{th}$ sub-band of the $i^{th}$ subframe.

12. An inter-channel level difference (ICLD) processing apparatus, comprising:

a memory configured to store instructions; and a processor coupled to the memory and configured to execute the instructions to:

receive a stereo audio signal;

parse the stereo audio signal frame by frame according to the stereo audio signal received by the receiving unit, to obtain a sub-band ICLD of each sub-band of each subframe of each frame of the stereo audio signal, wherein each frame comprises at least two subframes;

calculate a sum of absolute values of the sub-band ICLDs of each subframe of a frame of the stereo audio signal according to the sub-band ICLD of each sub-band of each subframe of the frame;

calculate a weighted ICLD value of each sub-band of the frame according to the sum of absolute values of the sub-band ICLDs of each subframe of the frame; and transmit stereo audio frame data that is based on the weighted ICLD values of the sub-bands.

13. The apparatus according to claim 12, wherein the processor is configured to execute the instructions to calculate the weighted ICLD value of each sub-band of the frame in a first weighting manner when an absolute value of a difference between the sums of the absolute values of the sub-band ICLDs of all pairs of subframes of the at least two subframes of the frame is less than a preset threshold.

14. The apparatus according to claim 13, wherein the processor is configured to execute the instructions to:

calculate a first weighting factor of a $b^{th}$ sub-band of an $i^{th}$ subframe according to a quantity of subframes of the frame, wherein i represents any subframe of the frame, and $0<i\le L$, wherein L is the quantity of subframes of the frame, and $L\ge 2$, wherein b represents any sub-band of the $i^{th}$ subframe, and $0<b\le K$, and wherein K represents a quantity of sub-bands of the $i^{th}$ subframe, and $K\ge 12$; and calculate the weighted ICLD value of the $b^{th}$ sub-band of the frame according to the first weighting factor and the sub-band ICLD of the $b^{th}$ sub-band of the $i^{th}$ subframe of the frame.

15. The apparatus according to claim 14, wherein the processor is configured to execute the instructions to calculate the first weighting factor of the $b^{th}$ sub-band of the $i^{th}$ subframe according to $fac_1(i,b)=1/L$, wherein $fac_1(i,b)$ represents the first weighting factor of the $b^{th}$ sub-band of the $i^{th}$ subframe.

16. The apparatus according to claim 15, wherein the processor is configured to execute the instructions to calculate the weighted ICLD value of the $b^{th}$ sub-band of the frame according to $$\text{level}(b) = \sum_{i=1}^{L} fac_1(i,b) * \text{level}(i,b),$$

wherein level(b) represents the weighted ICLD value of the $b^{th}$ sub-band of the frame, and wherein level(i, b) represents the sub-band ICLD of the $b^{th}$ sub-band of the $i^{th}$ subframe.

17. The apparatus according to claim 12, wherein the processor is configured to execute the instructions to calculate the weighted ICLD value of each sub-band of the frame in a second weighting manner when an absolute value of a difference between the sums of the absolute values of the sub-band ICLDs of at least one pair of subframes of the at least two subframes of the frame is greater than or equal to a preset threshold.

18. The apparatus according to claim 17, wherein the processor is configured to execute the instructions to:

calculate a second weighting factor of a $b^{th}$ sub-band of an $i^{th}$ subframe according to one of the calculated sum of the absolute values of the sub-band ICLDs of each subframe of the frame and the sub-band ICLD of the $b^{th}$ sub-band of the $i^{th}$ subframe of the frame, wherein i represents any subframe of the frame, and $0<i\le L$, wherein L is a quantity of subframes of the frame, and $L\ge 2$, wherein b represents any sub-band of the $i^{th}$ subframe, and $0<b\le K$, and wherein K represents a quantity of sub-bands of the $i^{th}$ subframe, and $K\ge 12$; and calculate a weighted ICLD value of the $b^{th}$ sub-band of the frame according to the second weighting factor and the sub-band ICLD of the $b^{th}$ sub-band of the $i^{th}$ subframe of the frame.

19. The apparatus according to claim 18, wherein the processor is configured to execute the instructions to calculate the second weighting factor of the $b^{th}$ sub-band of the $i^{th}$ subframe according to $$fac_2(i, b) = \text{sum}(i) \Big/ \sum_{j=1}^{L} \text{sum}(j),$$

wherein $fac_2(i,b)$ is the second weighting factor of the $b^{th}$ sub-band of the $i^{th}$ subframe, wherein sum(i) represents a sum of absolute values of sub-band ICLDs of all sub-bands of the $i^{th}$ subframe, wherein sum(j) represents a sum of absolute values of sub-band ICLDs of all sub-bands of a $j^{th}$ subframe, and wherein j is any subframe of the frame, and $0<j\leq L$.

20. The apparatus according to claim 18, wherein the processor is configured to execute the instructions to calculate the second weighting factor of the $b^{th}$ sub-band of the $i^{th}$ subframe according to $$fac_2(i, b) = |\text{level}(i, b)| \Big/ \sum_{j=1}^{L} |\text{level}(j, b)|,$$

wherein $fac_2(i,b)$ is the second weighting factor of the $b^{th}$ sub-band of the $i^{th}$ subframe wherein level(i, b) represents the sub-band ICLD of the $b^{th}$ sub-band of the $i^{th}$ subframe, and wherein level(j, b) represents a sub-band ICLD of the $b^{th}$ sub-band of a $j^{th}$ subframe.

21. The apparatus according to claim 20, wherein the processor is configured to execute the instructions to calculate the second weighting factor of the $b^{th}$ sub-band of the $i^{th}$ subframe according to $$fac_2(i, b) = \begin{cases} \dfrac{|\text{level}(i, b)|}{\sum_{j=1}^{L} |\text{level}(j, b)|} & b < \lceil M/2 \rceil \text{ or } b > K - \lfloor M/2 \rfloor \\ \dfrac{\sum_{l=-\lceil M/2 \rceil+1}^{\lfloor M/2 \rfloor} |\text{level}(i, b+l)|}{\sum_{j=1}^{L} \sum_{l=-\lceil M/2 \rceil+1}^{\lfloor M/2 \rfloor} |\text{level}(j, b+l)|} & \lceil M/2 \rceil \leq b \leq K - \lfloor M/2 \rfloor \end{cases},$$

wherein M represents a quantity of adjacent sub-bands, and wherein l represents a difference between an index number of an adjacent sub-band and an index number of a current sub-band.

22. The apparatus according to claim 18, wherein the processor is configured to execute the instructions to calculate the weighted ICLD value of the $b^{th}$ sub-band of the frame according to $$\text{level}(b) = \sum_{i=1}^{L} fac_2(i, b) * \text{level}(i, b),$$

wherein level(b) represents the weighted ICLD value of the $b^{th}$ sub-band of the frame, wherein $fac_2(i,b)$ is the second weighting factor of the $b^{th}$ sub-band of the $i^{th}$ subframe, and wherein level(i, b) represents the sub-band ICLD of the $b^{th}$ sub-band of the $i^{th}$ subframe.

* * * * *